US011850210B2

(12) United States Patent
Dadachanji et al.

(10) Patent No.: US 11,850,210 B2
(45) Date of Patent: Dec. 26, 2023

(54) TAMPER EVIDENT PLASTIC CLOSURE FOR VIALS FOR STORING SUBSTANCES FOR MEDICAL OR PHARMACEUTICAL APPLICATIONS AND USE THEREOF

(71) Applicant: KAISHA PACKAGING PRIVATE LIMITED, Maharashtra (IN)

(72) Inventors: Rishad Kairus Dadachanji, Mumbai (IN); Keyurkumar Arvindbhai Patel, Daman & Diu (IN)

(73) Assignee: KAISHA PACKAGING PRIVATE LIMITED, Maharashtra (IN)

( * ) Notice: Subject to any disclaimer, the term of this patent is extended or adjusted under 35 U.S.C. 154(b) by 67 days.

(21) Appl. No.: 17/727,160

(22) Filed: Apr. 22, 2022

(65) Prior Publication Data

US 2022/0354745 A1 Nov. 10, 2022

(30) Foreign Application Priority Data

May 6, 2021 (IN) ..... 202121020675

(51) Int. Cl.
*A61J 1/18* (2023.01)
*A61J 1/14* (2023.01)
(Continued)

(52) U.S. Cl.
CPC ..... *A61J 1/18* (2013.01); *A61J 1/1412* (2013.01); *B65B 3/003* (2013.01); *B65B 7/161* (2013.01);
(Continued)

(58) Field of Classification Search
CPC ..... A61J 1/18; A61J 1/1412; A61J 1/1425; A61J 1/1406; B65B 3/003; B65B 7/161;
(Continued)

(56) References Cited

U.S. PATENT DOCUMENTS 3,193,128 A 7/1965 Ravn
3,358,865 A 12/1967 Andersen
(Continued)

FOREIGN PATENT DOCUMENTS

BR 0103790 B1 8/2011
EP 0614820 A1 9/1994
(Continued)

OTHER PUBLICATIONS

Xolair® (omalizumab) Injection Preparation and Administration (https://www.xolairhcp.com/starting-treatment/administration.html retrieved on Apr. 9, 2022).
(Continued)

*Primary Examiner* — Nicholas J. Weiss
*Assistant Examiner* — Brandon W. Levy
(74) *Attorney, Agent, or Firm* — Renner, Otto, Boisselle & Sklar, LLP

(57) ABSTRACT

A tubular locking body of a tamper evident plastic closure for necked vials for holding a plug in a mouth of a vial includes a retaining member for retaining the plug, a central opening being formed in the retaining member for providing access to the inside of the vial via the plug. The cap includes a disc-shaped cover and a coupling portion, for coupling the cap with the tubular locking body by positive-fit engagement. The coupling portion includes at least one frangible portion each configured such that at least one indicator member remains as a tamper evidence at a rim of the central opening of the tubular locking body after removal of the cap from the distal end of the tubular locking body by irreversibly breaking the annular frangible portion for providing access to the inside of the vial via the plug.

22 Claims, 16 Drawing Sheets

Figure 1B:
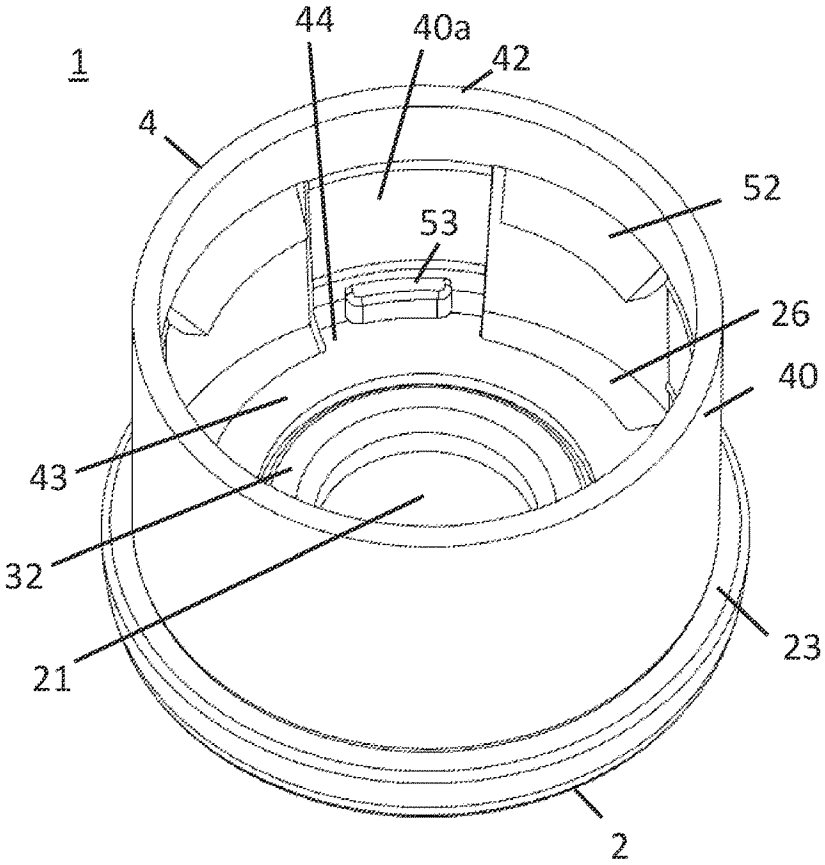

(51) Int. Cl.

| | |
|---|---|
| ***B65D 51/00*** | (2006.01) |
| ***B65B 3/00*** | (2006.01) |
| ***B65B 7/16*** | (2006.01) |
| ***B65B 7/28*** | (2006.01) |

(52) U.S. Cl.
CPC ..... *B65B 7/2821* (2013.01); *B65D 51/002* (2013.01); *B65D 2401/30* (2020.05)

(58) Field of Classification Search
CPC ..... B65B 7/2821; B65B 21/18; B65D 51/002; B65D 2401/30; B65D 55/024; B65D 41/58; B65D 2401/15; B65D 51/18; B65D 55/063; B65D 2401/00; B65D 2401/20; B65D 2543/00296; B65D 41/3428; B65D 2543/0062; B65D 2543/00731; B65D 2401/60; B65D 2401/10; B65D 47/10; B65D 39/088; Y10S 215/03; Y10S 215/901; Y10S 206/807; Y10S 206/828
See application file for complete search history.

(56) References Cited

U.S. PATENT DOCUMENTS

| | | | | |
|---|---|---|---|---|
| 3,888,377 | A | 6/1975 | Stadler | |
| 3,923,182 | A | 12/1975 | Choksi | |
| 3,974,008 | A | 8/1976 | Choksi | |
| D281,758 | S | 12/1985 | Trombly | |
| D298,575 | S | 11/1988 | Delmerico | |
| 4,941,580 | A | 7/1990 | Julian | |
| 5,048,706 | A | 9/1991 | de Vaujany | |
| 5,125,921 | A | 6/1992 | Duschek | |
| 5,152,413 | A | 10/1992 | Conrad | |
| 5,258,191 | A * | 11/1993 | Hayes | B65D 41/3428 426/107 |
| 5,735,419 | A | 4/1998 | Ma | |
| 6,042,770 | A | 3/2000 | Sudo et al. | |
| 6,089,541 | A | 7/2000 | Weinheimer et al. | |
| D437,556 | S | 2/2001 | Holliday et al. | |
| 6,382,442 | B1 | 5/2002 | Thibault et al. | |
| D477,225 | S | 7/2003 | Pinnavaia | |
| D530,607 | S | 10/2006 | Cornet et al. | |
| D600,120 | S | 9/2009 | Kawamura | |
| D616,090 | S | 5/2010 | Kawamura | |
| D620,358 | S | 7/2010 | Jewett et al. | |
| D630,944 | S | 1/2011 | Kawamura | |
| 8,225,949 | B2 * | 7/2012 | Aneas | B65D 51/002 604/905 |
| D678,771 | S | 3/2013 | Kawamura | |
| 8,684,204 | B2 | 4/2014 | Belle | |
| 8,684,225 | B2 | 4/2014 | Gelibert et al. | |
| 8,950,609 | B2 | 2/2015 | Aneas | |
| D724,944 | S | 3/2015 | Epstein | |
| 9,382,044 | B2 | 7/2016 | Chanas et al. | |
| D785,402 | S | 5/2017 | Shirley et al. | |
| D876,230 | S | 2/2020 | Hagg et al. | |
| D915,200 | S | 4/2021 | Ozturk | |
| 2010/0089862 | A1 | 4/2010 | Schmitt | |
| 2012/0160850 | A1 * | 6/2012 | Gelibert | B65D 55/063 220/315 |
| 2015/0166212 | A1 | 6/2015 | Wissner et al. | |
| 2016/0200488 | A1 * | 7/2016 | Friedrich | B65D 51/002 215/253 |
| 2018/0148232 | A1 * | 5/2018 | Castillo | B65D 51/002 |
| 2019/0344938 | A1 | 11/2019 | Lebon | |
| 2022/0354745 | A1 | 11/2022 | Dadachanji et al. | |

FOREIGN PATENT DOCUMENTS

| | | | |
|---|---|---|---|
| EP | 3326932 | A1 | 5/2018 |
| EP | 3381831 | A1 | 10/2018 |
| EP | 3821925 | A1 | 5/2021 |
| GB | 2222399 | A | 3/1990 |

OTHER PUBLICATIONS

First Examination Report for corresponding Indian Application No. 202121020675 dated Nov. 25, 2022.

Packaging South Asia. Kaisha Packaging supplies seals for Covid vaccines. Dec. 8, 2021. https://packagingsouthasia.com/type-of-packaging/caps-and-closures/kaisha-packaging-seals/ (Year: 2021).

Bio Spectrum. Kaisha Packaging supplies seals for 2 B doses of COVID-19 vaccines globally. Dec. 6, 2021. https://www.biospectrumindia.com/news/60/20130/kaisha-packaging-supplies-seals-for -2-b-doses-of-covid-19-vaccines-globally-.html (Year: 2021).

First Office Action for related U.S. Appl. No. 29/790,693 dated Aug. 29, 2023.

* cited by examiner

TAMPER EVIDENT PLASTIC CLOSURE FOR VIALS FOR STORING SUBSTANCES FOR MEDICAL OR PHARMACEUTICAL APPLICATIONS AND USE THEREOF

CROSS-REFERENCE TO RELATED APPLICATION

The present invention claims priority of Indian patent application no. 202121020675 "Tamper evident plastic closure for vials for storing substances for medical or pharmaceutical applications and use thereof", filed on May 6, 2021, the whole content of which is hereby incorporated by reference.

FIELD OF INVENTION

The present invention relates to a tamper evident plastic closure for vials that are used for storing substances for medical or pharmaceutical applications and to methods using such a tamper evident plastic closure, particularly for sealing a vial with such a tamper evident plastic closure and for withdrawal a liquid including a substance for medical or pharmaceutical applications from a vial or for reconstituting a drug inside a vial.

BACKGROUND OF INVENTION

Bottles or vials of glass or plastic material for storing pharmaceutical products such as lyophilized or liquid products for injection or perfusion are commonly known from the prior art. Such vials are generally closed by means of a rubber plug that can be pierced by a needle. Usually, the rubber plug is held on the neck of a vial by means of an aluminum capsule that completely covers the rubber plug and has a portion that may be removed by tearing, which allows access to the rubber plug. However, such aluminum capsules cannot cover the plug in a sterile manner and in the absence of undesired particles. Such aluminum capsules make it therefore difficult to minimize the level of particle contamination admitted into controlled-atmosphere environments, such as a clean room.

To overcome such drawbacks, cap structures have been provided that include a cover that can be removed for providing access to the plug via a central opening of a sleeve-shaped member mounted to the distal end of the vial. Such cap structures are known e.g. from U.S. Pat. No. 3,193,128 or 3,358,865.

To further reduce the costs and ease the mounting of such cap structures at the distal end of a vial, plastic cap structures have been provided that include a tubular locking body that can be mounted at the neck of a vial by means of locking tabs or the like and that include a cover that can be torn-off for providing access from the outside of the tubular locking body to the inside of the vial via a central opening of the tubular locking body and the plug. Such a closure cap is disclosed e.g. in EP 0 614 820 A1.

Providing tamper evidence means in such cap structures is another important aspect. For this purpose, U.S. Pat. No. 5,152,413 discloses a tamper evident closure including frangible bridges that remain visible after removal of the cover.

EP 3 326 932 A1 discloses a closure system for vials comprising an inner capsule configured to be fitted on the neck of the vial and hold the plug in a sealed closure configuration of the mouth of the vial and an outer capsule able to be fitted onto the inner capsule. The outer capsule is made in a single body and comprises an upper disc-shaped portion configured to close the opening of the inner capsule and a lower portion able to be fitted around the inner capsule, wherein the outer capsule comprises a frangible portion implemented as a breaking line between the upper disc-shaped portion and the lower portion.

US 20120160850 A1 discloses a closure cap similar to that of EP 3 326 932 A1. The cap is snap fastened on a ring by first inserting a bead provided on a bottom surface of the cap into the central opening of the ring and then applying heat to deform the bead in order to give it an L-shaped profile that is bent around the rim of the central opening. The tubular body of the closure cap consists of two members, namely of a cage that can be locked on the neck of a vial, and a cylindrical member locked to the cage.

US 20160200488 A1 discloses a tamper evident plastic closure. The frangible portion is not provided in a coupling portion of the cap, but in a ferrule, the lower portion of the skirt of which is crimped inwardly such that it engages the lower surface of the rim of the vial from beneath. Specific locking tabs for locking the ferrule to the neck of a vial are not disclosed. When a user lifts off the cap from the ferrule, at least some of the bridging webs connecting the hub of the tamper evidence mechanism to an annular portion on the top surface of the ferrule break, which can be determined by a customer. FIGS. 8 and 9 of US 20160200488 A1 also disclose an embodiment, where the rim of a central opening on the top surface of the ferrule may be relatively smooth after removal of the cap.

SUMMARY OF INVENTION

It is an object of the present invention to provide a low-cost and reliably tamper evident plastic closure for vials that can be mounted easily and is convenient in use, for holding a plug in the mouth of a vial in a sealed configuration. It is a further object of the present invention to provide a method for sealing a vial with such a tamper evident plastic closure and for withdrawal a liquid including a substance for medical or pharmaceutical applications from a vial or for reconstituting a drug inside a vial.

According to the present invention there is provided a tamper evident plastic closure for vials for storing substances for medical or pharmaceutical applications having a neck with a flange at an axial end thereof, for holding a plug in a mouth of a vial, said plastic closure comprising: a tubular locking body having a distal end and a proximal end and being configured to be mounted at the neck of the vial, and a cap coupled with the locking body at the distal end thereof; wherein the tubular locking body comprises a retaining member provided at the distal end thereof, configured for retaining the plug to be held in the mouth of the vial, wherein a central opening is formed in the retaining member for providing access from the outside of the tubular locking body to the inside of the vial via the plug, and wherein the cap comprises a disc-shaped cover for covering the distal end of the locking body and closing the central opening of the locking body, and a coupling portion provided at a center of the disc-shaped cover and protruding from a bottom surface thereof, for coupling the cap with the locking body by positive-fit engagement of the coupling portion with the central opening of the locking body, wherein the disc-shaped cap and the locking body are formed as separate members, and the tubular locking body is formed as a single-piece sleeve configured to cover the entire region of the neck of the vial.

According to the present invention the coupling portion comprises an annular frangible portion integrally formed with the disc-shaped cover and protruding from the bottom surface of the disc-shaped cover, a cylindrical protrusion protruding from the bottom surface of the disc-shaped cover and an indicator ring, the cylindrical protrusion and the indicator ring are connected with each other via the annular frangible portion and configured such that, after removal of the cap from the distal end of the tubular locking body by irreversibly breaking the at annular frangible portion for providing access to the inside of the vial via the plug, the indicator ring remains as a tamper evidence at the rim of the central opening of the tubular locking body that is clamped or held with axial play between the bottom of the retaining member and an upper surface of the plug and protrudes in radial direction inward beyond the rim of the central opening of the tubular locking body into the central opening.

Thus, the indicator ring remains clearly visible in the central opening of the locking body, as a clearly visible tamper evidence indicator. At the same time, the indicator ring also reliably prevents closing or re-sealing the plug by means of a replacement cap.

The coupling portion comprises at least one frangible portion each configured such that at least one indicator member remains as a tamper evidence at a rim of the central opening of the locking body after removal of the cap from the distal end of the locking body by irreversibly breaking the at least one frangible portion for providing access to the inside of the vial via the plug.

A tamper evident plastic closure according to the present invention can thus be used to reliable cover or seal the plug of a vial during storage and transportation, and provides easy access to the content of the vial after removal of the cap by irreversibly breaking the at least one frangible portion of the coupling protrusion. After breaking the at least one frangible portion of the coupling protrusion, at least one indicator member, which is preferably formed as an indicator ring, remains in the central opening of the locking tab as a clearly visible tamper evidence indicator, which also reliably prevents closing or re-sealing the plug by means of a replacement cap. For this purpose, the tubular locking body may be formed as a sleeve covering the entire region of the neck of the vial, and the cap is preferably configured to cover the entire region of the plug, which is held in the mouth of the vial. As the disc-shaped cap and the locking body are formed as separate members, both components can be produced in separate manufacturing steps and assembled later to the tamper evident closure, e.g. after locking the locking body to the neck region of the vial.

According to a further embodiment, a plurality of locking tabs or protrusions are integrally formed on an inner surface of the tubular locking body, wherein the locking tabs are configured to lock the tubular locking body at the neck of the vial.

According to a further embodiment, the retaining member is formed as an annular web, which is connected with a cylindrical side-wall of the tubular locking body via a plurality of radial webs spaced apart from each other along the perimeter of the tubular locking body and with a plurality of curved recesses formed between adjacent radial webs, wherein a plurality of locking tabs is provided near the proximal end of the locking body at positions corresponding to the plurality of curved recesses, for locking the locking body at the neck of the vial, in particular by positive-fit with a bottom surface of the flange of the vial. Thus, the locking body together with the locking tabs can be formed integrally in a single injection-molding process. Here, the annular web serves to prevent an accidental removal of the plug from the neck of the vial. However, neither the annular web nor the at least one indicator member necessarily pushes the plug permanently into the mouth of the plug. Rather, the plug may be retained in the mouth of the vial with a certain axial play.

According to a further embodiment, slanted surfaces are formed along the perimeter of the central opening, each extending at an acute angle relative to a line perpendicular to the axial direction of the tubular locking body, wherein the slanted surfaces enclose at least one linear rim portion of the at least one indicator member extending in the axial direction of the tubular locking body. The length of the at least one linear rim portion can be used to properly adjust the stiffness of the annular web, whereas the resiliency of the mounting of the cap to the locking tab can be adjusted by means of a proper slope of the slanted surfaces. As the rim of the central opening is slanted at least on the upper surface of the annular web, this may also ease insertion of a swab for disinfection of the upper surface of the plug before piercing the plug by the needle or distal tip of a syringe.

According to a further embodiment, the annular frangible portion may have a notch-shaped profile, thus providing a region of reduced wall thickness near the free end of the coupling portion. Thus, the force necessary for breaking the annular frangible portion can be easily adjusted.

According to a further embodiment, an upper surface of the indicator ring extends in parallel with a bottom surface of a peripheral rim of the central opening of the locking body.

According to a further embodiment, a bottom surface of the indicator ring is convexly curved so that the indicator ring may abut against the upper surface of the plug along an annular contact line.

According to a further embodiment, an upper surface of the indicator member or ring is inclined toward the bottom surface of the cap under an acute angle which is the same as the acute angle formed between the bottom of the retaining member and a plane perpendicular to the axial direction of the plastic closure, which eases the positive-fit engagement of the coupling portion with the central opening of the locking body and maximizes the contact area between the two components, which eases properly adjusting the force required for actually breaking the frangible portion.

According to a further embodiment, a peripheral rim of the cap protrudes in radial direction outward beyond an outer surface of the tubular locking member and a ring-shaped concave recess is formed on an upper surface of the disc-shaped cover. This eases grasping the cap for handling and tearing the cap off from the locking tab to thereby break the frangible portion.

According to a further embodiment, the coupling portion is snap-fitted into the central opening of the locking body for assembly of the tamper evident plastic closure. As an alternative, the coupling portion may comprise a front end that is irreversibly deformed by plastic deformation or by heating and plastic deformation for establishing the positive-fit engagement of the coupling portion with the central opening of the locking body during assembly of the closure and when covering or sealing the plug of the vial.

According to a further embodiment, the plug is retained inside the tubular locking body by a plurality of locking tabs or protrusions provided on an inner surface of the tubular locking body. Thus, the closure can be delivered to customers with the plug already held inside the tubular locking body. For closing the vial by insertion of the plug into the mouth of the vial, it is then sufficient to simply put tamper evident plastic closure onto the axial end of the vial and push the tamper evident plastic closure onto the axial end of the vial until the tubular locking body is locked at the neck of the vial. When pushing down the tamper evident plastic closure onto the axial end of the vial, the plug is automatically inserted into the mouth of the vial.

According to a further related aspect of the present invention there is provided a method for sealing a vial for storing a substance for medical or pharmaceutical applications having a neck with a flange at an axial end thereof, comprising: providing the vial, filling the vial with the substance and closing the vial by inserting a plug into the mouth of the vial; providing a tamper evident plastic closure as outlined above; putting the tamper evident plastic closure onto the axial end of the vial; and locking the tubular locking body at the neck of the vial, so that the retaining member retains the plug on an expanded upper rim of the vial and the indicator member abuts clamped against the bottom of the retaining member.

According to a further embodiment of this method the step of putting the tamper evident plastic closure onto the axial end of the vial comprises: snap-fitting the coupling portion into the central opening of the locking body or irreversibly deforming a front end of the coupling portion by plastic deformation or by heating and plastic deformation, for establishing the positive-fit engagement of the coupling portion with the central opening of the locking body.

According to a further related aspect of the present invention there is provided a method for withdrawal of a liquid including a substance for medical or pharmaceutical applications from a vial, which is sealed by a plug that is covered by a tamper evident plastic closure as claimed in any of the preceding claims, comprising: pushing a peripheral rim of the disc-shaped cover away from the tubular locking body for removing the cap from the distal end of the locking body such that the at least one frangible portion is broken and the at least one indicator member is left behind at the rim of the central opening of the locking body to thereby provide access to the inside of the vial via the plug; piercing a central portion of the plug with the front tip of a syringe penetrating the central opening of the tubular locking body; and withdrawal of the liquid from the vial by pulling a piston of the syringe.

According to a further embodiment, first a liquid is injected into the inside of the vial via the plug by pushing the piston of the syringe and a substance stored inside the vial is mixed with the liquid injected into the vial before the liquid including the substance for medical or pharmaceutical applications is withdrawn from the vial.

According to a further related aspect of the present invention there is provided a tamper evident plastic closure for vials for storing substances for medical or pharmaceutical applications having a neck with a flange at an axial end thereof, for holding a plug in a mouth of a vial, said plastic closure comprising: a tubular locking body having a distal end and a proximal end and being configured to be locked at the neck of the vial, and a cap coupled with the locking body at the distal end thereof; wherein the tubular locking body comprises: a retaining member provided at the distal end thereof, configured for retaining the plug to be held in the mouth of the vial, wherein a central opening is formed in the retaining member for providing access from the outside of the tubular locking body to the inside of the vial via the plug; and wherein the cap comprises: a disc-shaped cover for covering the distal end of the locking body and closing the central opening of the locking body; wherein the disc-shaped cover is coupled to the retaining member by positive-fit engagement of a coupling portion protruding from a bottom surface of the disc-shaped cover with the central opening of the locking body; wherein the coupling portion comprises an annular frangible portion so that the cap can be removed from the locking body by irreversibly breaking the annular frangible portion for providing access to the inside of the vial via the plug; wherein the central opening is configured such that an upper surface of the plug can be disinfected by a swab after removal of the cap from the locking body by irreversibly breaking the annular frangible portion.

According to a further embodiment a rim of the central opening is formed by a slanted surface extending at an acute angle relative to a line perpendicular to the axial direction of the tubular locking body so that a virtual extension line of the slanted surface intersects the upper surface of the plug at a radial position or near the radial position of an inner surface of the coupling portion before breaking the annular frangible portion. As an alternative or additional feature, an opening width and/or depth of the central opening may be dimensioned such that a swab can be inserted into the central opening by the finger of a user for disinfection of the upper surface of the plug.

According to a further related aspect of the present invention there is provided a tamper evident plastic closure for vials for storing substances for medical or pharmaceutical applications having a neck with a flange at an axial end thereof, for holding a plug in a mouth of a vial, said plastic closure comprising: a tubular locking body having a distal end and a proximal end and being configured to be locked at the neck of the vial, and a cap coupled with the locking body at the distal end thereof; wherein the tubular locking body comprises: a retaining member provided at the distal end thereof, configured for retaining the plug to be held in the mouth of the vial, wherein a central opening is formed in the retaining member for providing access from the outside of the tubular locking body to the inside of the vial via the plug; and wherein the cap comprises: a disc-shaped cover for covering the distal end of the locking body and closing the central opening of the locking body; wherein the disc-shaped cover is coupled to the retaining member by positive-fit engagement of a coupling portion protruding from a bottom surface of the disc-shaped cover with the central opening of the locking body; wherein the coupling portion comprises an annular frangible portion so that the cap can be removed from the locking body by irreversibly breaking the annular frangible portion for providing access to the inside of the vial via the plug; wherein at least one window is formed in a side-wall of the tubular locking body and a fluid-path is formed between an ambient and the upper surface of the plug and/or an outer surface of the vial in the region of the neck and flange when the tamper evident plastic closure is locked at the neck of the vial.

OVERVIEW ON DRAWINGS

Figure 1A:
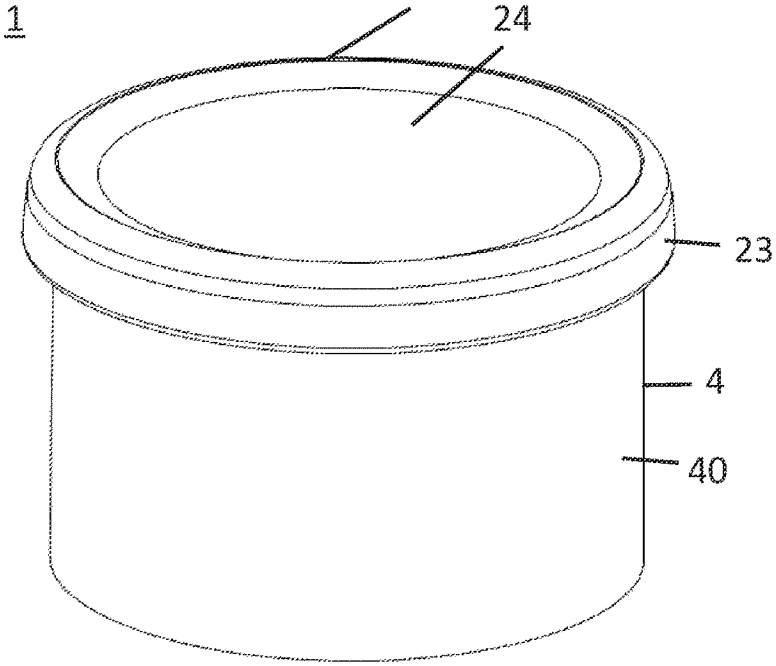
Figure 2A:
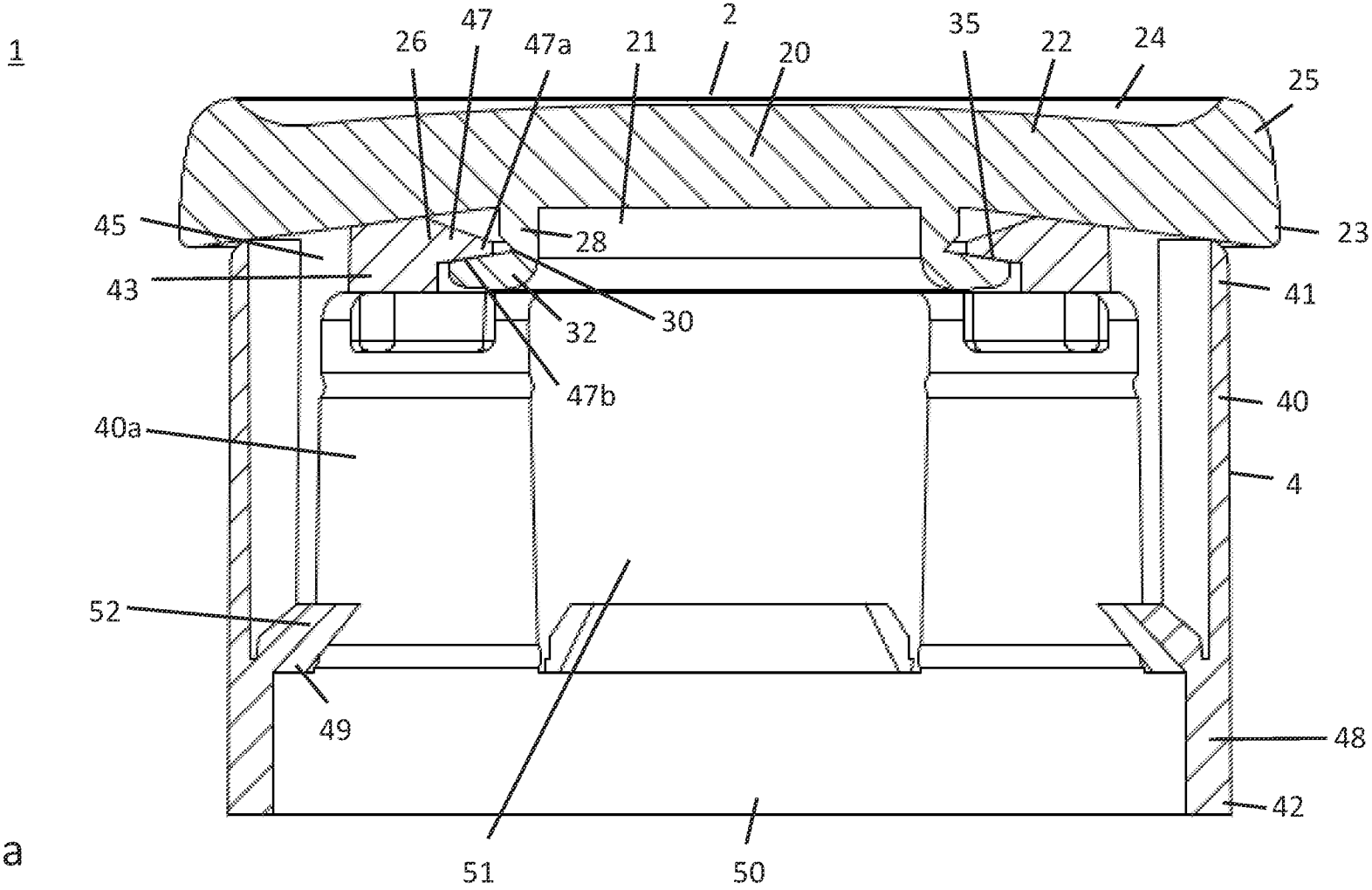
Figure 2B:
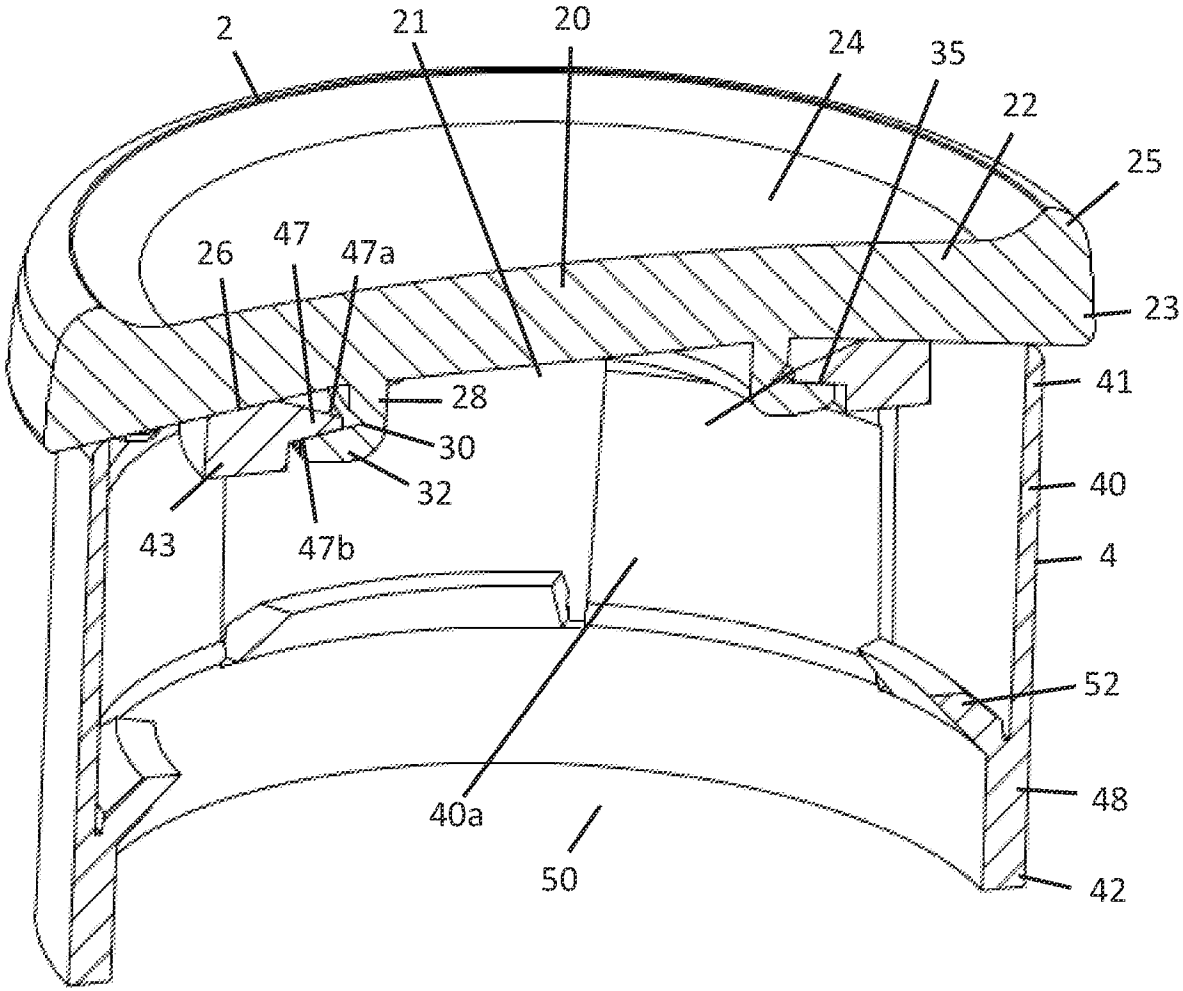
Figure 3A:
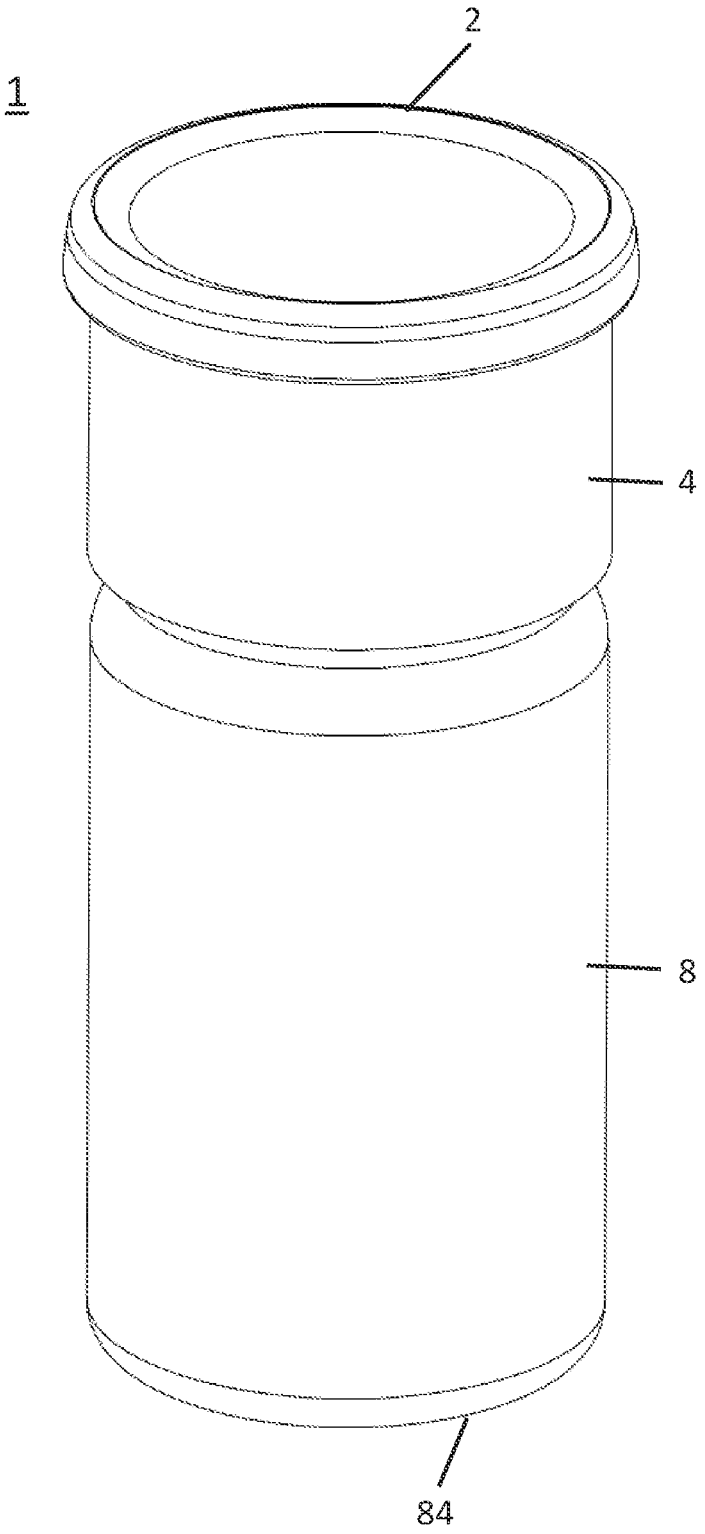
Figure 3B:
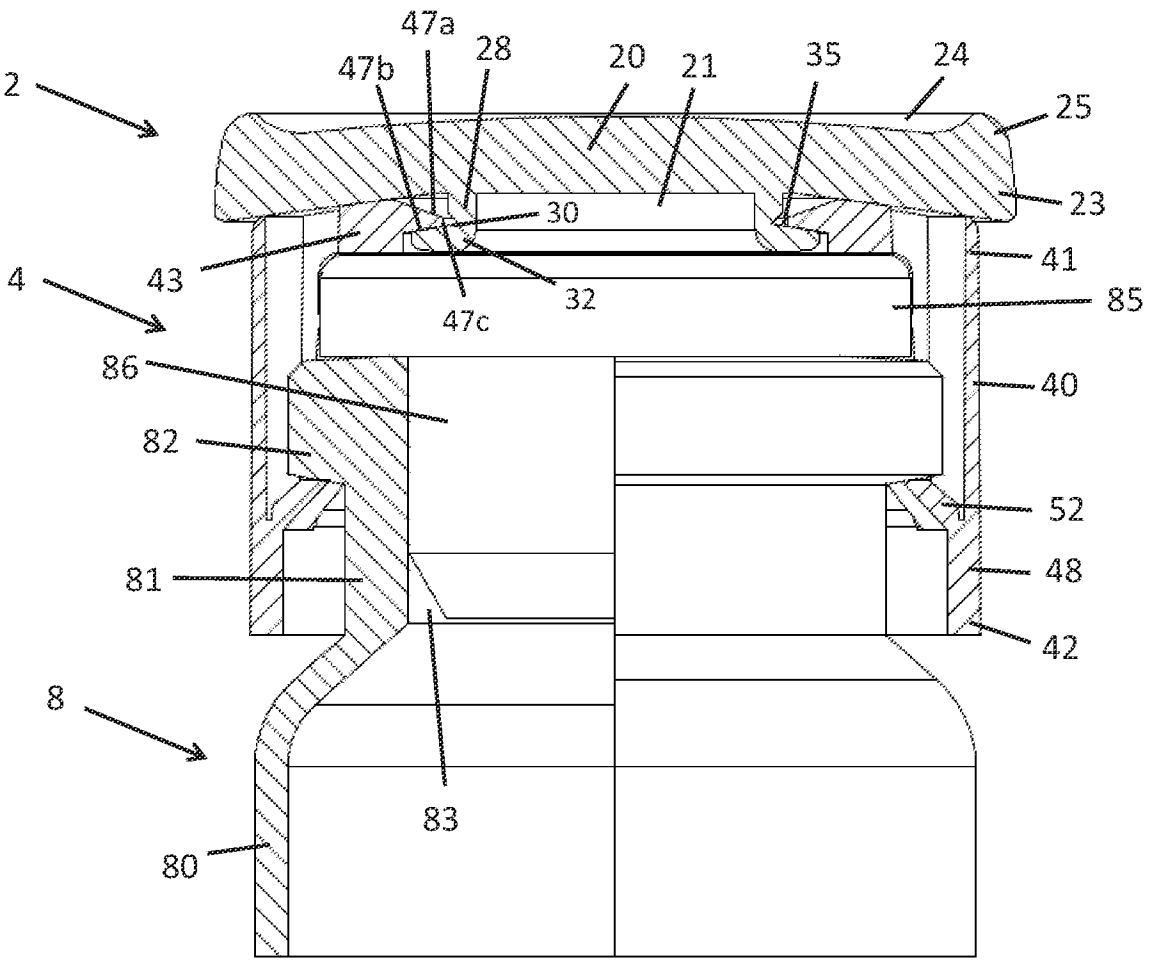
Figure 3C:
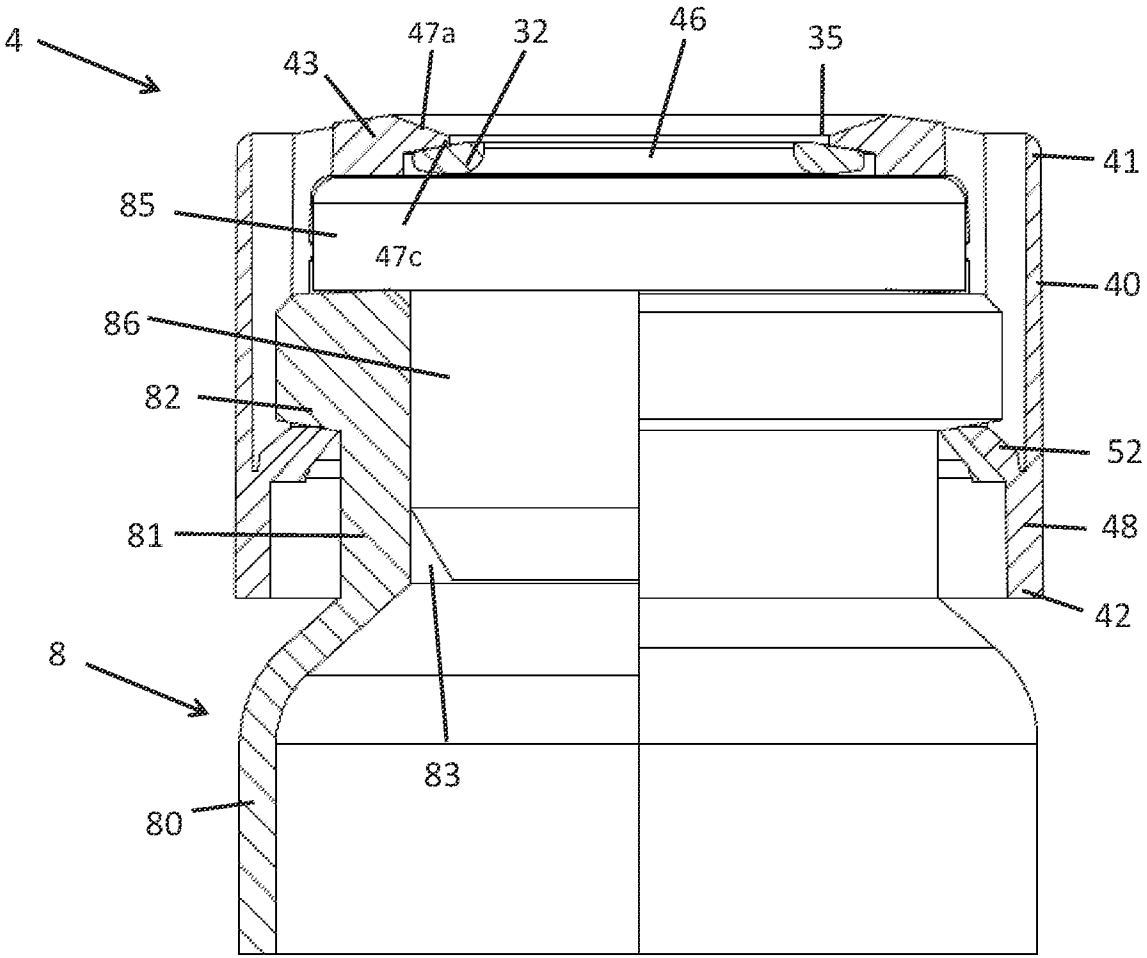
Figure 3D:
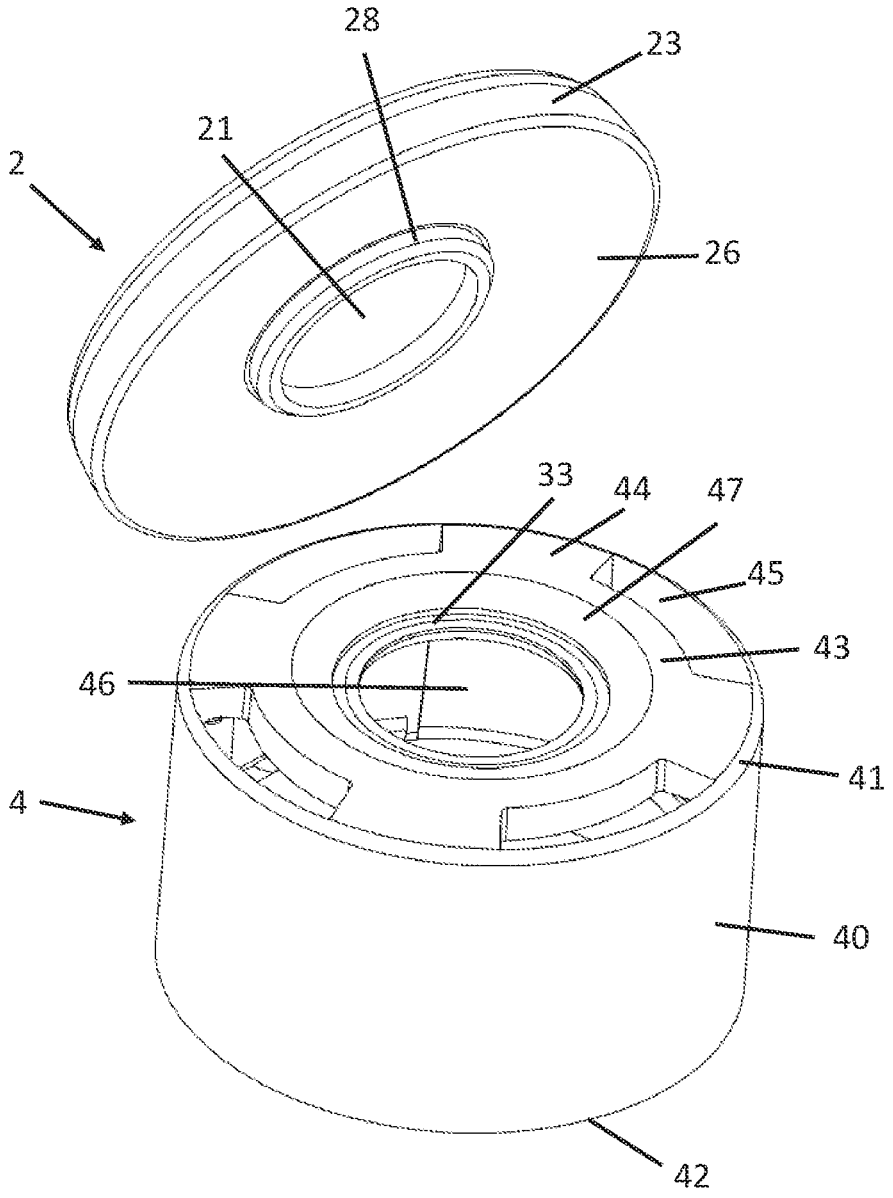
Figure 4B:
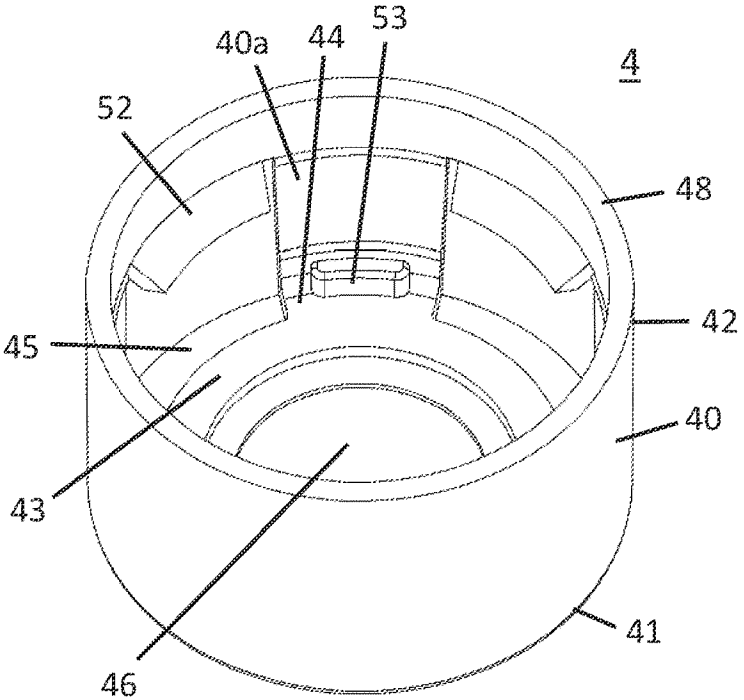
Figure 4A:
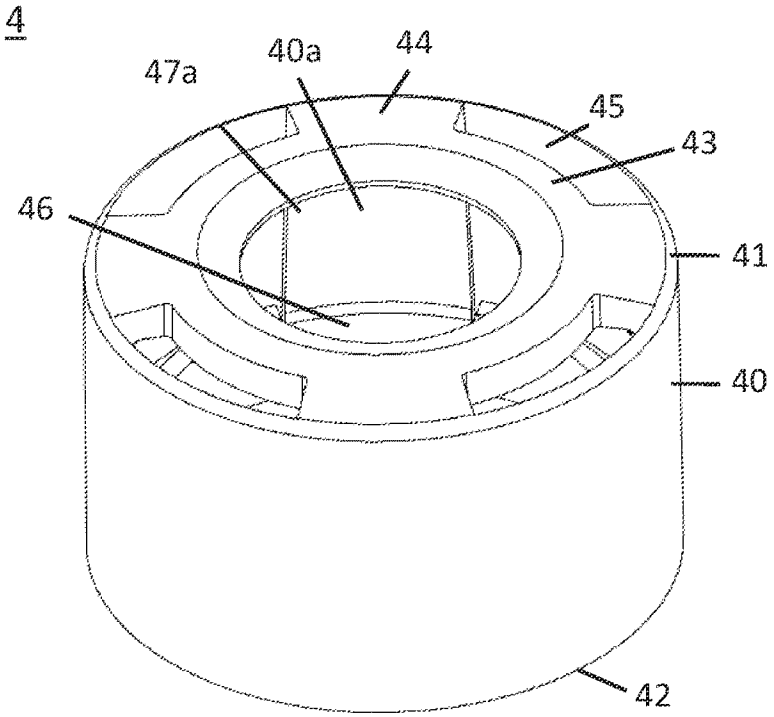
Figure 5B:
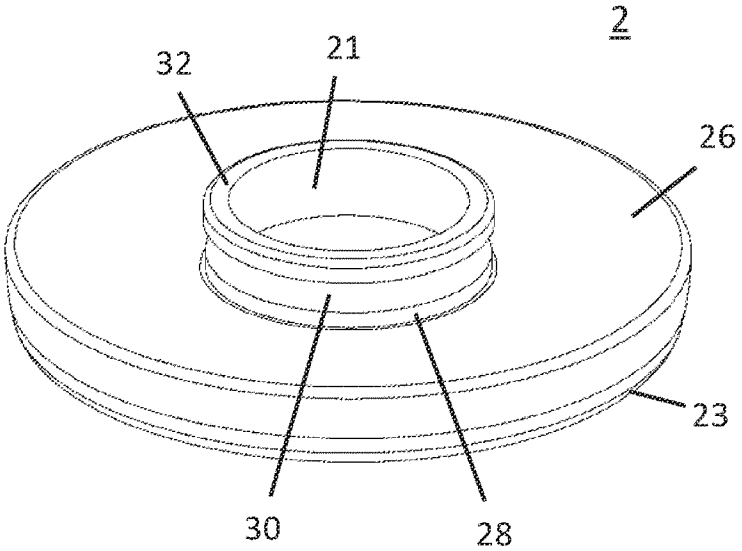
Figure 5A:
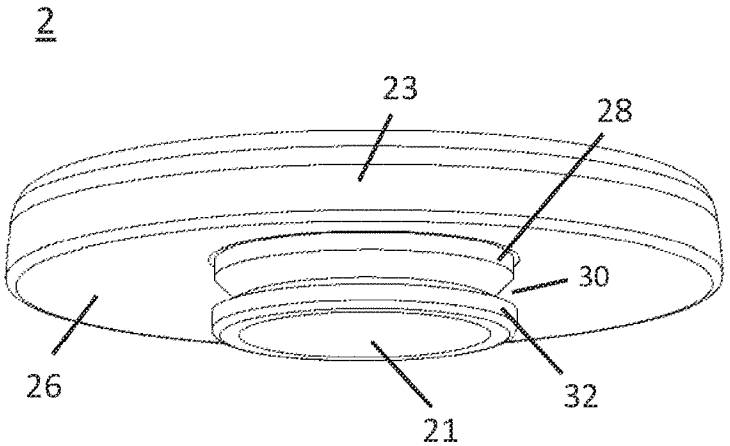
Figure 5C:
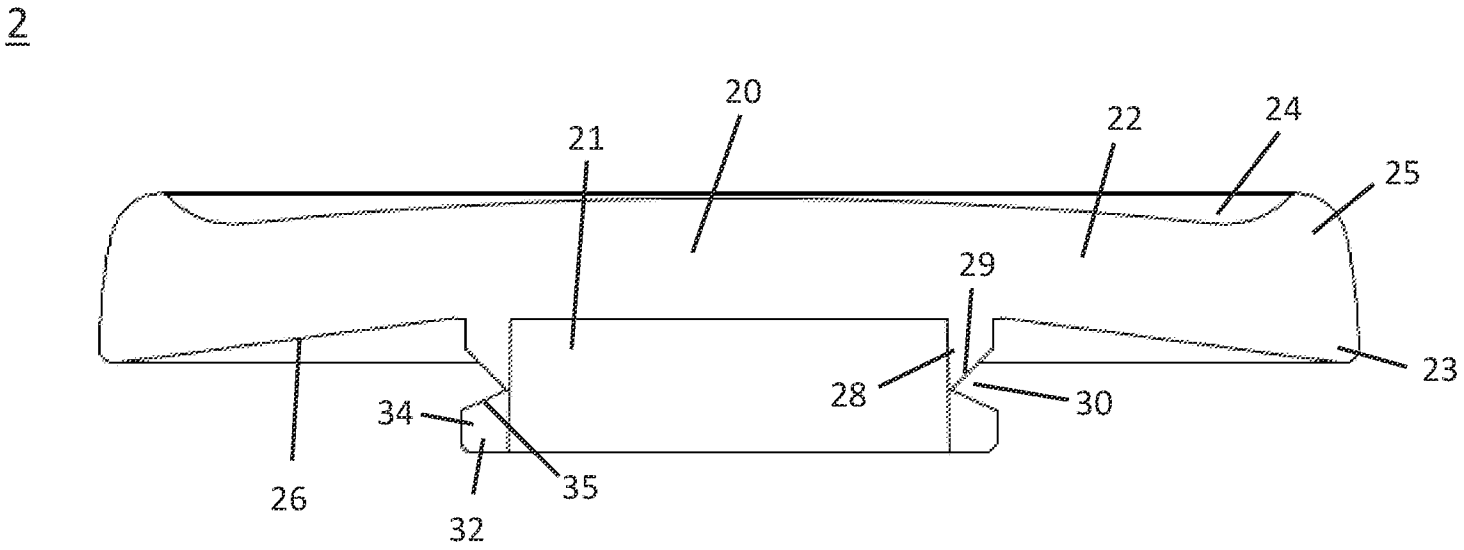
Figure 6A:
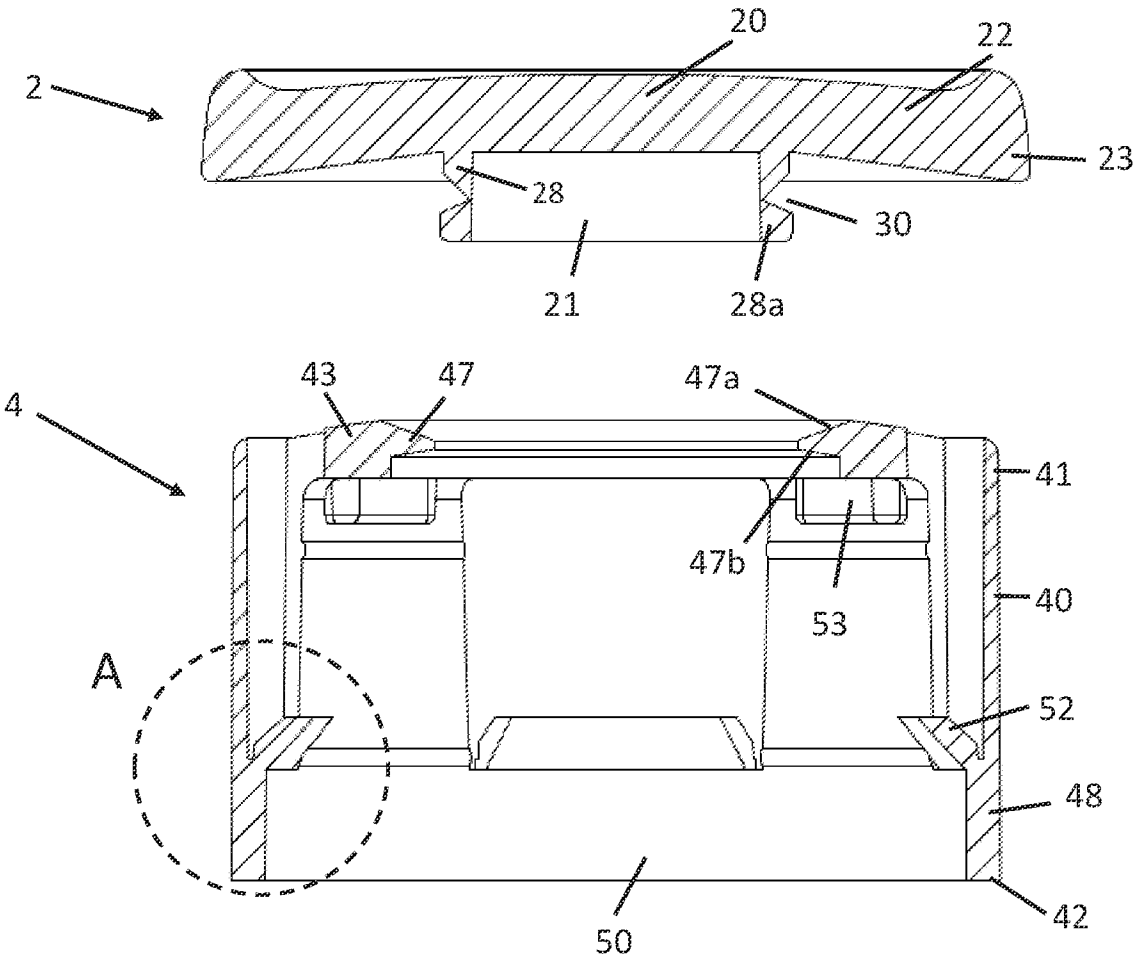
Figure 6B:
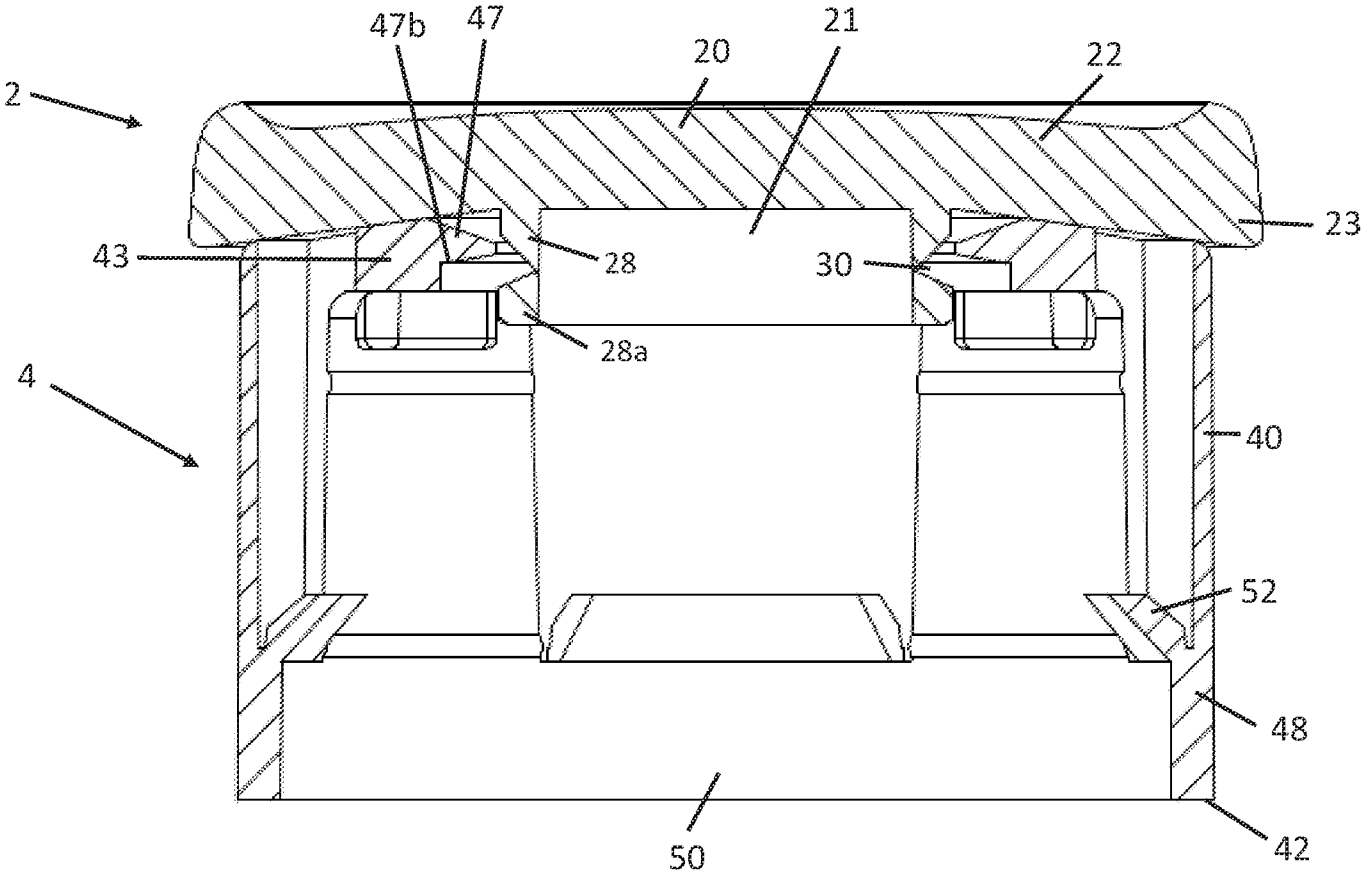
Figure 6C:
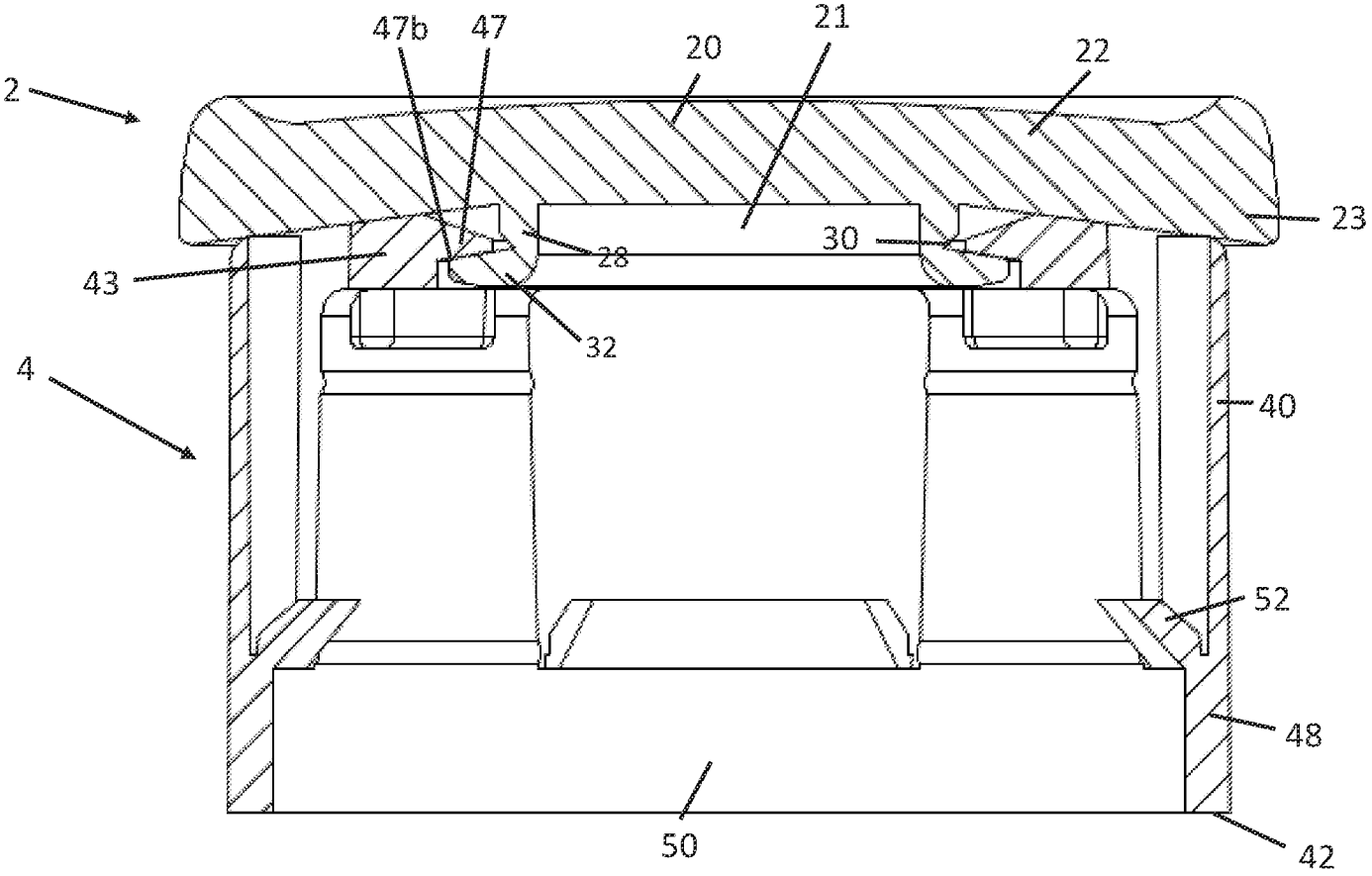
Figure 6D:
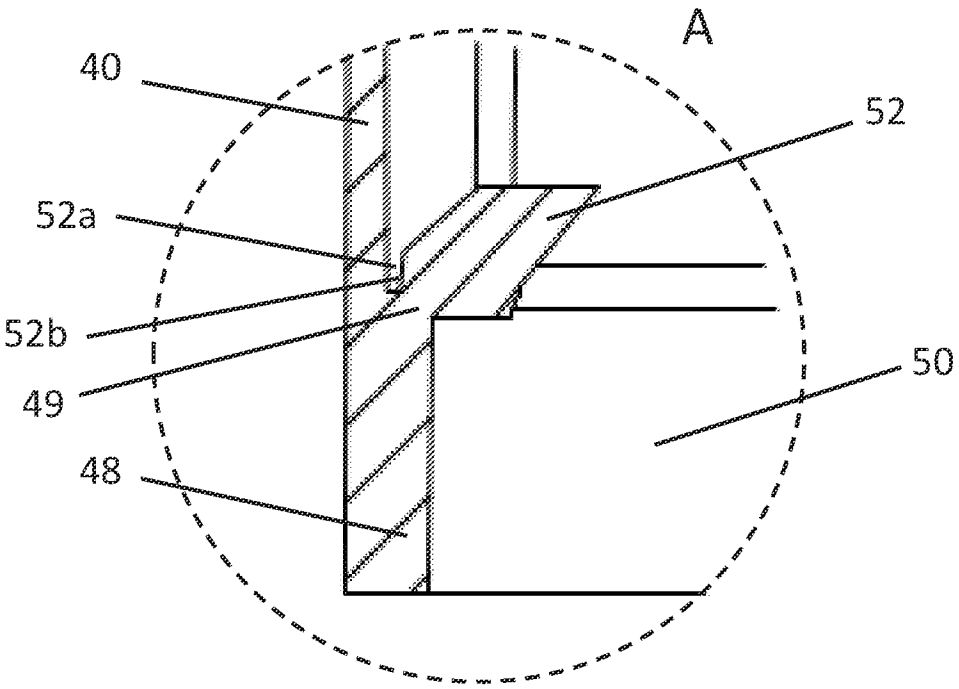
Figure 6E:
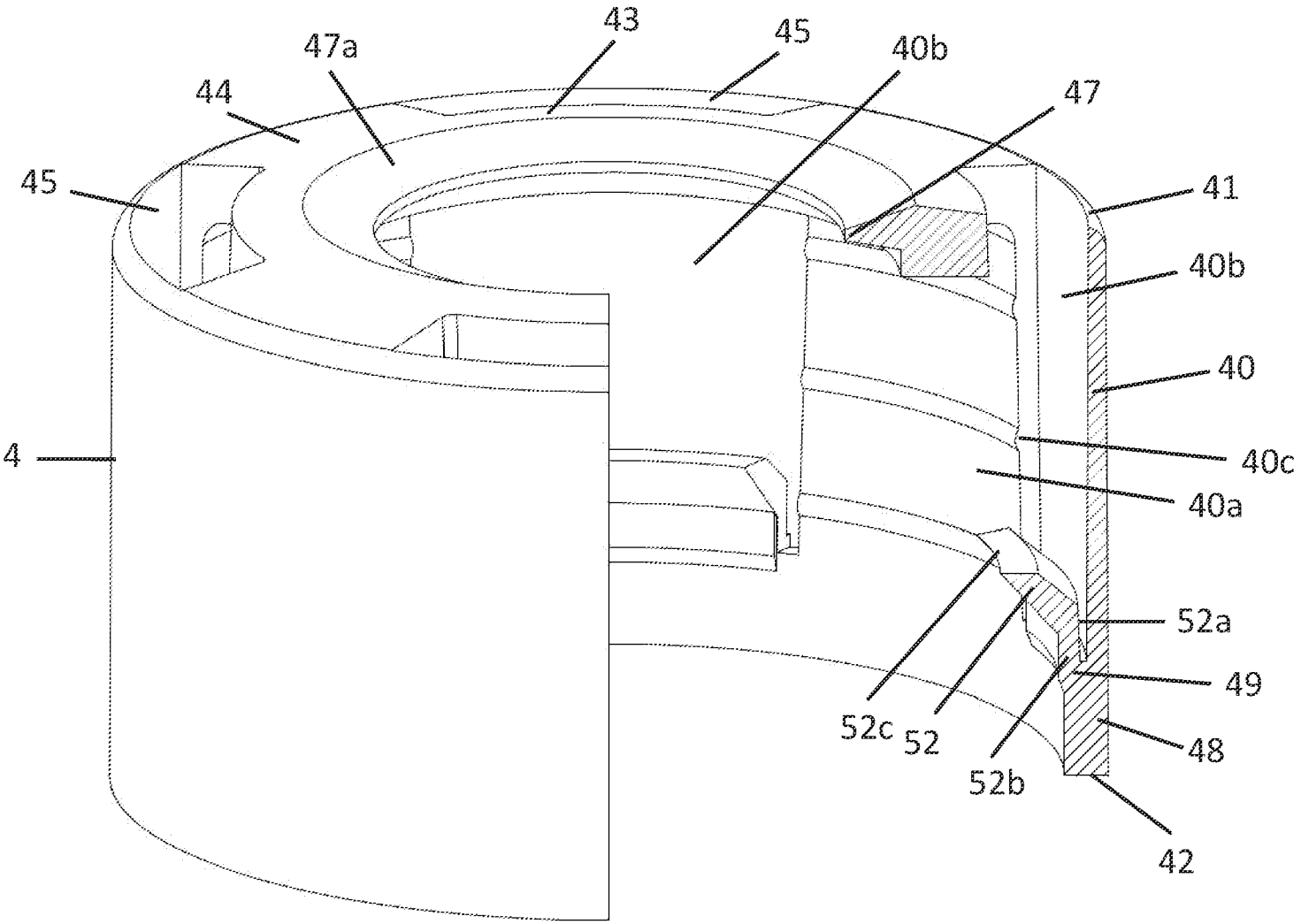
Figure 7B:
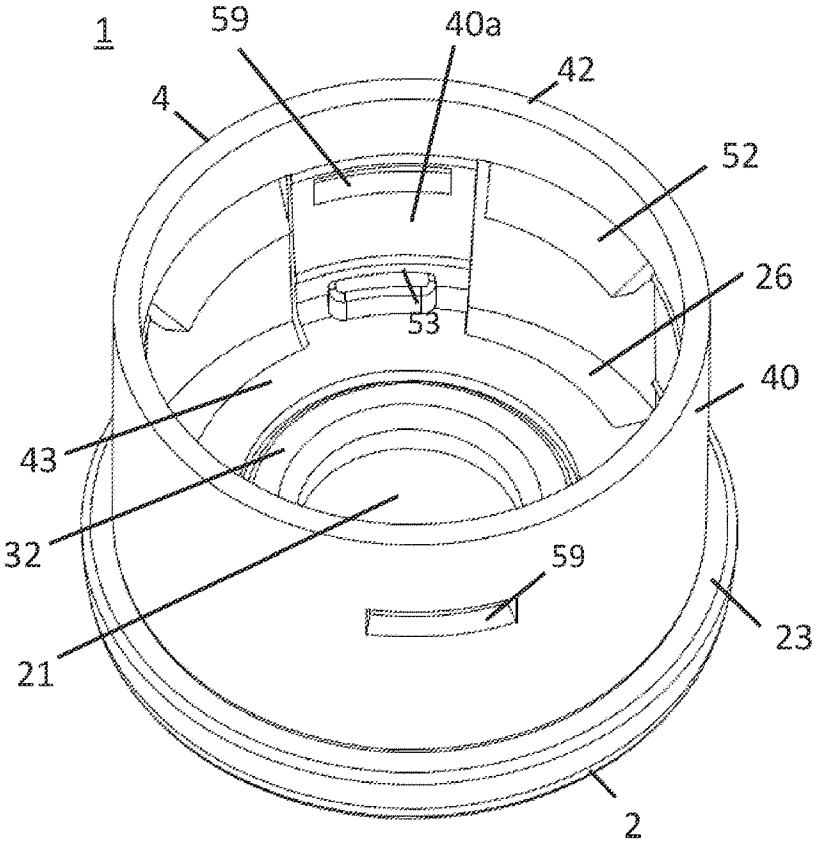
Figure 7A:
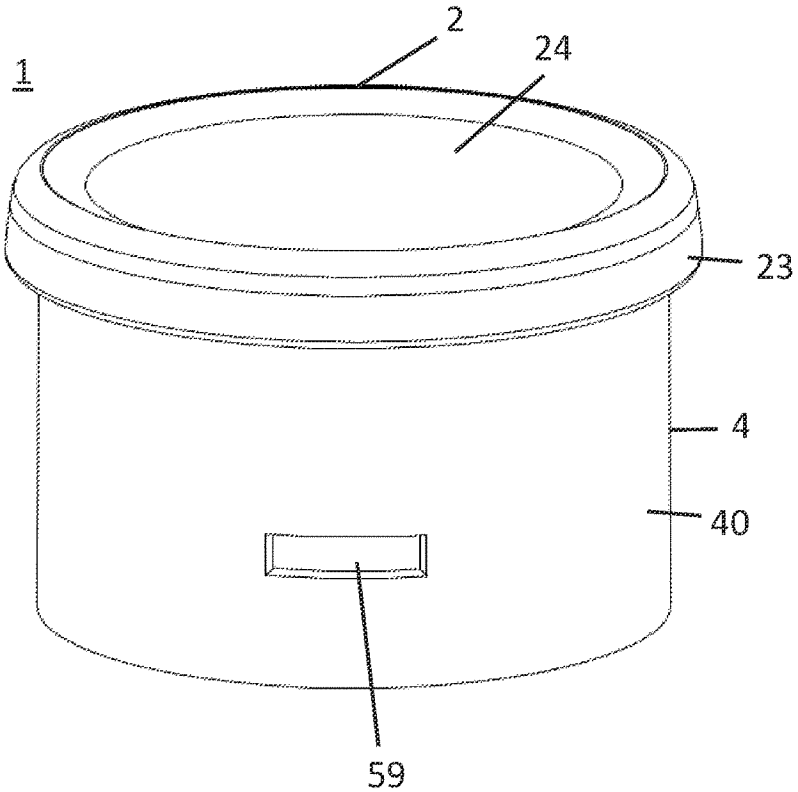

Hereinafter, the preferred embodiments according to the present invention will be described in an exemplary manner and with reference to the accompanying drawings, wherein:

FIGS. 1*a* and 1*b* show a tamper evident plastic closure according to the present invention in a perspective top view and perspective bottom view;

FIGS. 2*a* and 2*b* show the tamper evident plastic closure according to a first embodiment of the present invention in a cross-sectional view and a perspective partial cross-sectional view;

FIG. 3*a* shows the tamper evident plastic closure according to the first embodiment of the present invention in a state when mounted to the distal end of vial;

FIG. 3*b* shows the tamper evident plastic closure according to the first embodiment of the present invention in the state of FIG. 3*a* in a cross-sectional view;

FIG. 3*c* shows the tamper evident plastic closure according to the first embodiment of the present invention in the state of FIG. 3*a* in a cross-sectional view with the cap removed from the tubular locking body;

FIG. 3*d* is an exploded view of a tamper evident plastic closure according to the present invention in a state with the cap removed from the tubular locking body;

FIGS. 4*a* and 4*b* show the tubular locking body of a tamper evident plastic closure according to the present invention in a perspective top view and perspective bottom view;

FIGS. 5*a* and 5*b* show the cap of a tamper evident plastic closure according to the first embodiment of the present invention in a perspective top view and perspective bottom view;

FIG. 5*c* shows the cap of a tamper evident plastic closure according to the first embodiment of the present invention in a schematic cross-sectional view;

FIG. 6*a* shows the tamper evident plastic closure according to a second embodiment of the present invention in a state before coupling the cap with the tubular locking body;

FIG. 6*b* shows the tamper evident plastic closure according to the second embodiment of the present invention in a state when the coupling portion of the cap is inserted into the central opening of the annular retaining member of the tubular locking body and before irreversibly deforming the front end of the coupling portion;

FIG. 6*c* shows the tamper evident plastic closure according to the second embodiment of the present invention in a state after irreversible deformation of the front end of the coupling portion;

FIG. 6*d* shows detail A of FIG. 6*a* on a larger scale;

FIG. 6*e* shows the tubular locking body of FIG. 6*a* according to a further embodiment in a perspective view with partial cross-section; and FIGS. 7*a* and 7*b* show a tamper evident plastic closure according to another embodiment of the present invention in a perspective top view and perspective bottom view.

Throughout the drawings, the same reference numerals designate identical or technically equivalent elements or groups of elements.

DETAILED DESCRIPTION OF EMBODIMENTS

A tamper evident plastic closure according to the present invention is configured for holding a rubber plug in the mouth of a necked container, particularly of a vial. An example of such a vial is schematically shown in FIGS. 3*a* and 3*b*. The vial 8 has a cylindrical basic shape, having a cylindrical side wall 80 with constant inner and outer diameters, which projects vertically from a flat vial bottom 84, which merges in a constricted neck portion 81 of a relatively short axial length near the upper open end of the vial 8 and then merges in an expanded upper rim 82 (so-called rolled edge; hereinafter the 'flange'), which has a larger outer diameter than the associated neck portion 81 and surrounds a mouth 83 of the vial 8. As can be concluded from FIG. 3*b*, the underside of the rolled edge (flange) 82 is slanted and extends downward under an acute angle and towards the constricted neck portion 81. The neck portion 81 may be formed with smooth walls and without an external thread or may be provided with an external thread for screwing on a closure member. A central cylindrical body 86 of the rubber plug or stopper 85 is inserted into the mouth 83 of the neck portion 81 and the upper end of the rubber plug 83 rests on the upper rim 82, so that the vial 8 is sealed in a gas-tight manner and protected against the intrusion of contaminants into the inside of the vial 8.

Such vials 8 are used for storage of substances or agents for cosmetic, medical or pharmaceutical applications, which are to be stored in one or several components in solid or liquid form in the container. Especially in the case of glass containers storage periods can amount many years, notably depending on the hydrolytic resistance of the glass type used. While, in the following, cylindrical vials are disclosed, it should be noted that the vials, in the sense of the present invention, may also have a different profile, for example a square, rectangular or polygonal profile.

Such vials are made of a transparent or colored glass or of a suitable plastic material by blow molding or plastic injection molding techniques, and in general can be internally coated so that the material of the vial emits minimal impurities to the agent to be received.

The central body 86 of the rubber plug 85 can be pierced either by the needle of a syringe (not shown) or by the front tip of a needle-less syringe if the rubber plug 85 includes a valve member as disclosed e.g. in U.S. Pat. No. 6,089,541, for withdrawal of liquid from the vial or injection of a liquid into the vial for drug reconstitution before withdrawal of the liquid including a drug for medical or pharmaceutical applications.

FIGS. 1*a* and 1*b* are schematic perspective views of a tamper evident plastic closure 1 according to the present invention that is used for holding the rubber plug in the mouth of a vial in a sealed state, keeping the upper surface of the rubber plug under sterile conditions during storage and is configured for providing access to the inside of the vial via the rubber plug. The tamper evident plastic closure 1 generally consists of a tubular locking body 4 and of a cap 2 that covers the distal end of the locking body 4 and is coupled or connected to the locking body 4.

Referring to FIGS. 1*b* to 2*b*, the locking body 4 is a hollow, cylindrical member formed by a cylindrical side-wall 40 of circular profile having a distal end 41 and a proximal end 42. On the inner surface 40*a* of the side-wall 40 a plurality of resilient locking tabs 52 is provided, which are spaced apart from each other under equiangular intervals. The locking tabs 52 protrude radially inward into the locking body under an acute angle toward the distal end 41. When the locking body 4 is put into the upper rim of a vial, the locking tabs 52 are resiliently flexed outwards towards the inner surface 40*a* of the side-wall 40. The locking tabs 52 are mated to the shape of the neck portion of the vial so that the locking tabs 52 can grip behind the bottom surface of the widened upper rim (flange) 82 of a vial 8, as shown in FIG. 3*b*, for locking the tubular locking body 4 at the neck portion 81 of the vial 8.

Referring to FIGS. 4*a* and 4*b*, the upper (distal) end of the locking body 4 is formed by an annular web 43 that may be connected with the cylindrical side-wall 40 via a plurality of radial webs 44 that are spaced apart from each other along the perimeter of the tubular locking body 4. A plurality of curved recesses 45 is thus formed between adjacent radial webs 44. Each of the resilient locking tabs 52 is disposed at a position corresponding to a corresponding recess 45 near the proximal end 42, which eases forming the resilient locking tabs 52 integrally with the tubular locking body 4 by injection molding. A circular central opening 46 is formed by the annular web 43.

As will be described in the following in more detail, the annular web 43 serves as a retaining member for retaining a rubber plug to be held in the mouth of a vial, when the locking body 4 is locked at the neck of the vial. For this purpose, the annular web 43 does not necessarily push the rubber plug onto the flange at the axial end of the vial. Rather, the plug may be accommodated with a certain axial play inside the tubular locking body 4, when the locking body 4 is locked at the neck of the vial.

As shown in FIG. 2*a*, the bottom skirt 48 of the locking body 4 may be provided with a larger wall thickness than the side-wall 40 so that the resilient locking tabs 52 are supported on a radial step 49 on the inner surface 40*a*, which divides the inner volume of the locking body 4 into an upper receptacle 51 and a bottom receptacle 50. The height of the bottom receptacle 50 generally corresponds to the axial length of the neck portion 81 of a vial 8 (see FIG. 3*b*) so that the region where the resilient locking tabs 52 engage with the bottom side of the upper rim 82 of a vial 8 is reliably protected. On the other hand, the height of the upper receptacle 51 that is formed between the upper ends of the locking tabs 52 and the bottom surface of the annular web 43 generally corresponds to or may be slightly less than the height of the upper rim 82 of a vial and the thickness of the peripheral rim of a plug 85 (see FIG. 3*b*) so that the peripheral rim of the plug 85, if required, may be firmly pressed onto the upper rim 82 of a vial to seal the mouth 83 in a gas-tight manner. At the same time that portion on the upper surface of the plug 85 inside the central opening 46 may be sealed in a sterile manner as outlined below in more detail, for preventing intrusion of contaminants into this region, although such a sterile sealing of the plug 85 is not of primary importance according to the present invention and may also not be provided. In other words, when the locking body 4 is locked at the neck of a vial, there may exist a certain axial play between the bottom surface of the annular web 43 and the upper surface of a plug disposed in the mouth of the vial and between the indicator ring 32 and the upper surface of the plug, so that the upper surface of the plug is not kept under sterile conditions inside the tamper evident plastic closure 1.

As shown in FIGS. 1*b* and 2*a*, a plurality of block-shaped positioning members 53 may be formed at central positions on the bottom side of the radial webs 44. The positioning members 53 are each curved along the inner surface 40*a* of the side-wall 40 and together enclose a circular region of a diameter that corresponds to or is slightly larger than the outer diameter of the disc-shaped upper part of the plug 85 so that the plug 85 can be positioned also in radial direction by the block-shaped positioning members 53 of the tubular locking body 4 in the state shown in FIG. 3*b*.

As shown in FIGS. 2*a*, 4*a* and 4*b*, the annular web 43 may comprise a radial protrusion 47 that is preferably annular, extending along the entire perimeter of the central opening, projects in radial direction inward into the central opening and is less thick, if viewed in axial direction, than the corresponding annular web 43. As outlined below, the radial protrusion is gripped behind by an indicator ring 32 that forms the bottom portion of a cap 2 that is coupled with the locking body by positive-fit engagement of the indicator ring 32 with the perimeter of the central opening 46.

The cap 2 includes a disc-shaped central body 20 that covers the whole of the locking body 4 at the distal end 41 thereof. Preferably, the bottom of the peripheral rim 23 rests on the annular distal end 41 of the locking body 4 to thereby prevent intrusion of contaminants to the inside of the locking body 4. As shown in FIGS. 2*a* and 5*c*, a hollow, cylindrical protrusion 28 is formed at the central position of the bottom 26 of the cap 2, with an inner diameter that corresponds to that of the central opening 46 of the locking body 4. For coupling the cap 2 with the locking body 4, the bottom end of the cylindrical protrusion 28 is provided with an indicator ring 32 that protrudes outward in radial direction. The indicator ring 32 is connected with the cylindrical protrusion 28 via a notch-shaped frangible portion 30 of a smaller thickness than the cylindrical protrusion 28. The frangible portion 30 thus is less stable than the cylindrical protrusion 28 and the indicator ring 32 and can thus be broken for removing the cap 2 from the locking body 4, as outlined below in more detail.

As shown in FIG. 2*a*, the bottom side of the indicator ring 32 may have a convex shape in profile so that the indicator ring 32 can abut against the upper surface of the plug 85 only along a narrow circular contact line, to thereby seal the upper surface of the plug 85 (cf. FIG. 3*b*) in the region of the central opening 46 in a sterile manner and prevent the intrusion of contaminants into this region. According to the present invention, such an abutment of the bottom side of the indicator ring 32 against the upper surface of the plug 85 is, however, not absolutely necessary. Rather, a certain distance may still exist between the bottom side of the indicator ring 32 and the upper surface of the plug 85, when the locking body 4 is locked at the neck 81 of the vial 8. As the entire region of the axial end of the vial 8 is covered by the tubular locking body 4 and the cap 2, the intrusion of contaminants into the inside of the closure is at least prevented to a large extent, which may be sufficient to remove reliably any contaminants remaining on the upper surface of the plug 85 before use by disinfecting the upper surface of the plug 85 by a swab and a disinfection solution, such as alcohol.

As shown in FIG. 2*a*, the upper surface 47*a* and the bottom surface 47*b* of the radial protrusion 47 is each slanted under an acute angle relative to a plane perpendicular to the axial direction of the locking body 4. Preferably, however, the front end of the radial protrusion is not V-shaped but instead C-shaped, with a small linear portion 47*c* extending in the axial direction, thus providing a higher stability against rupture of the front end 47*c* of the radial protrusion, e.g. when the cap 2 is removed from the locking body 4 by breaking the annular frangible portion 30. At the same time, the reduced material thickness of the radial protrusion 47 with its linear portion 47*c* extending in axial direction enables a certain resiliency of the radial protrusion, which, on the one hand, assists in applying a uniform pressure onto the indicator ring 32 along its entire perimeter, and, on the other hand, eases insertion of the indicator ring 32 into the central opening 46 of the locking body 4. Furthermore, this resiliency of the radial protrusion 47 can also assist in biasing the bottom surface of the cap 2 against the annular distal end 41 of the locking body 4, for sealing the entire inner volume of the locking body 4 against the environment.

As shown in FIG. 2*a*, the upper surface 35 of the indicator ring 32 is slanted under the same acute angle relative to a plane perpendicular to the axial direction of the locking body 4 as the bottom surface 47*b* of the radial protrusion, to thereby ensure a full surface contact between the two surfaces 35, 47*b* when the indicator ring 32 is in positive-fit engagement with the central opening 46 of the locking body.

As shown in FIGS. 2*a* and 5*c*, the bottom surface 26 of the cap 2 has a concave profile so that the front end 47*c* of the radial protrusion 47 and the notch-shaped frangible portion 30 are about at the same level as the bottom of the peripheral rim 23 and the annular rim at the distal end 41 of side-wall 40. As shown in FIG. 2*a*, the peripheral rim 23 of the central body 20 may extend beyond the outer perimeter of the side-wall 40 of locking body 4, so that the cap 2 may be removed easily from the locking body 4 by pushing the peripheral rim 23 upwards with a user's thumb. On the upper surface of the cap 2 an annular concave recess 24 is formed, which may result in formation of an annular upper rim 25 along the perimeter of the cap 2. Thus, the peripheral rim 23 of the cap 2 may also be actuated easily by a user for removal of the cap 2 by grasping the upper rim 25 with a forefinger and the bottom of peripheral rim 23 with a thumb.

As shown in FIG. 2*a*, the contour of the upper surface of the annular web 43 may by matched to the profile of the bottom surface 26 of the cap 2, to further enhance the sealing of the central recess 21 and the central opening 46 of the locking body 4.

Further details of the annular frangible portion 30 are shown in FIG. 5*c*. The notch-shaped frangible portion 30 may be formed by two slanted surfaces 39, 35 that converge under an acute angle in the annular frangible portion 30 with a residual material thickness that is just a small fraction of that of the cylindrical protrusion 28. As shown in FIG. 2*a*, when the indicator ring 32 of cap 2 is in positive-fit engagement with the central opening 46 of the locking body 4, the upper end of the linear front end 47*c* of radial protrusion 47 preferably does not contact the slanted surface on the bottom end of cylindrical protrusion 28.

As will become apparent to the skilled person, although the indicator ring 32 has been disclosed above as an annular member, as an alternative the cap 2 may be provided with a multi-piece indicator member consisting of a plurality of indicator portions, each of the same profile and functionality as outlined above for the indicator ring 32, that may be arranged at equiangular intervals along the perimeter at the bottom end of cylindrical protrusion 28.

Mounting a plastic closure according to a first embodiment of the present invention, as outlined above, onto the distal end of a vial will be discussed in the following with reference to FIGS. 3*a* and 3*b*. Firstly, the plastic closure 1 is assembled by coupling the cap 2 with the tubular locking body 4. The plastic closures 1 may be supplied to a pharmaceutical filling company separately from the vials 8, e.g. sterile sealed in a plastic bag or container. Preferably, the plastic closures 1 are supplied to a pharmaceutical filling company together with the vials 8. For this purpose, nested packaging solutions may be used, where a plurality of vials 8 are supported by carriers (so-called "nests") in a regular arrangement that are each accommodated in a tub-shaped container that is sterile sealed against the environment, as disclosed e.g. in US 2015/0166212 A1. Such a nested packaging solution may also be used for storing and supplying a plurality of plastic closures 1 correspondingly. A nest for holding a plurality of vials 8 in a regular arrangement and a nest for holding a plurality of plastic closures 1 in the same regular arrangement may also be accommodated together in the same tub-shaped container, which is sterile sealed against the environment, for storing and supplying the vials 8 together with the plastic closures 1 to a customer, such as a pharmaceutical filling company.

To obtain the sealed vial 8 shown in FIG. 3*a*, the locking body 4 of the plastic closure 1 is put onto the distal end of the vial 8, once the plug 85 has been inserted into the mouth 83 of the vial 8, as shown in FIG. 3*b*. When the plastic closure 1 is put onto the distal end 41 of the vial 8 in this state, the upper rim 82 of the vial 8 will be inserted first into the tubular bottom receptacle formed by the bottom skirt 48 of the locking body 4 the inner diameter of which is about of the same as the outer diameter of the upper rim 82 of the vial 8. When the locking body 4 is pushed further toward the vial 8, the resilient tabs 52 start flexing outward in radial direction toward the inner surface of the side-wall 40, which is possible because of the gap in radial direction between the inner surface of side-wall 40 and the outer peripheral surface of upper rim 82 of the vial 8. Finally, the front ends of the resilient webs 82 will have slid along the entire axial length of the upper rim 82 and will flex back again toward the neck portion 81 to grip behind the bottom surface of upper rim 82 and be locked at the neck portion 81 of vial 8. In this state, the bottom surface of the annular web 43 may be in contact with the upper surface of plug 85, which is, however, not necessary. Also in this state, the bottom surface of indicator ring 32 may be pressed against the upper surface of plug 85, to thereby reliably push the central body 86 of plug 85 into the mouth 83 of the vial and seal the region of the cylindrical recess 21 of cap and the upper surface of the plug 85 in the region of the central opening 46 sterile against the environment.

Such a sterile sealing is, however, not absolutely necessary according to the present invention, so that according to other embodiments there may also exist a certain axial play between the bottom surface of the annular web 43 and the upper surface of plug 85 and between the bottom surface of indicator ring 32 and the upper surface of plug 85.

In this state, as shown in FIGS. 3*a* and 3*b*, the vial 8 sealed or covered by the plastic closure 1 may be delivered to customers or end-users.

As will become apparent to the skilled person particularly from FIG. 3*b*, the plastic closure 1 may also be delivered to customers with the plug 85 already retained or held inside the tubular locking body 4. For retaining the plug 85 inside the tubular locking body 4, the locking tabs 52 formed on the inner surface of the side-wall 40 may be used, which requires that the outer diameter of the plug 85 corresponds to or slightly exceeds the width of a circular space formed by the plurality of locking tabs 52. According to an alternative embodiment, additional protrusions (not shown in the drawings) may be formed on the inner surface of the side-wall 40.

In such an embodiment, in order to obtain the sealed vial 8 shown in FIG. 3*a*, the locking body 4 of the plastic closure 1 together with the plug 85 held inside the tubular locking body 4 is put onto the distal end of the vial 8. When the plastic closure 1 with the plug 85 held approaches the vial 8, the plug 85 will be finally inserted into the mouth 83 of the vial 8, for sealing the vial 8. At this stage, the resilient tabs 52 may already grip behind the bottom surface of upper rim 82 to lock the vial 8 at the neck portion 81 of vial 8. Or alternatively, a certain axial play may still prevail between the upper ends of the resilient tabs 52 and the bottom surface of upper rim 82 at this stage, and when the plastic closure 1 is pushed further onto the distal end 41 of the vial 8 in this state, finally the resilient tabs 52 will flex outward in radial direction toward the inner surface of the side-wall 40 and finally grip behind the bottom surface of upper rim 82 to lock the vial 8 at the neck portion 81 of vial 8.

In order to provide access to the plug 85 for administering a drug, a user first has to remove the cap 2 from the locking body 4 by breaking the frangible portion 30 of the cap 2. After removal of the cap, as shown in FIG. 3*c*, the annular indicator ring 32 (or of the plurality of individual indicator members) will remain clamped or accommodated with axial play between the slanted bottom surface 35 of the radial protrusion 47 and the upper surface of plug 85. In this state, a portion 33 of the annular indicator ring 32 (or of the plurality of individual indicator members) will protrude in radial direction into the central opening 46 of the locking body 4 and will be clearly visible to the user, as a visible tamper evidence means clearly indicating that the cap has been removed already by breaking the frangible portion of the cap. At the same time, as the annular indicator ring 32 (or the plurality of individual indicator members) remains clamped or accommodated with axial play along the perimeter of the central opening 46 and cannot be removed without breaking other parts of the locking body 4, such as the annular web 43, it is not possible anymore to seal again the central opening 46 and the plug 5 by coupling another (fresh un-used) cap again with the locking body. To further enhance the tamper evident indicating effect, the annular indicator ring 32 (or of the plurality of individual indicator members) may have a different color than other parts of the locking body 4, particular than the annular web 43 and the radial protrusion 47.

It is noted that the annular indicator ring 32 (or of the plurality of individual indicator members) is not necessarily clamped between the slanted bottom surface 35 of the radial protrusion 47 and the upper surface of plug 85 after breaking the frangible portion 30. It is only important that the annular indicator ring 32 (or of the plurality of individual indicator members) does not get lost mistakenly or can be peeled out of the central opening 46 by a user. Of course, the annular indicator ring 32 (or of the plurality of individual indicator members) could be movable to a certain extent inside the central opening 46.

In the state of FIG. 3*c*, the user can pierce a central portion of the plug 85 with the needle of a syringe penetrating the central opening 46 of the tubular locking body 4 and then withdraw liquid from the vial by pulling a piston of the syringe for administering a drug. Although the central portion of the plug, inside the central opening 46, is sterile sealed against the environment, a user will usually first clean this central portion with a disinfecting swab via the central opening.

If it should be necessary to first reconstitute the drug inside the vial, the user will first inject a liquid, which is stored in a syringe, into the inside of the vial via 8 the plug 85 by pushing the piston of the syringe. Then, a substance stored inside the vial 8 can be mixed with the liquid injected into the vial 8 for reconstituting the drug. Finally, the liquid including the substance for medical or pharmaceutical applications is withdrawn from the vial 8 again by pulling the piston of the syringe.

As will become apparent to the skilled person when studying the above, the plug 85 may also be pierced with the front tip of a needle-less syringe, e.g. if the plug includes a valve member as disclosed e.g. in U.S. Pat. No. 6,089,541, for withdrawal of liquid from the vial or injection of a liquid into the vial for drug reconstitution before withdrawal of the liquid including a drug for medical or pharmaceutical applications.

For removing the cap 2 from the locking body 4 in the state of FIG. 3*b*, a user will grasp or actuate the peripheral rim 23 of the cap, as outlined above, to push or tear the cap 2 upward, preferably under an acute angle relative to the axial direction of the locking body 4. However, the outer cover portion 22, the cylindrical protrusion 28, the frangible portion(s) 30, the indicator ring 32 and the radial protrusion 47 of the annular web 43 provide a certain degree of resiliency in the plastic closure, so that an accidental rupture of the frangible portion(s) 30 can be prevented, when only small forces are exerted onto the cap 2 for removal. Thus, an accidental opening of the plastic closure 1 can be reliably prevented.

The cap 2 can be removed from the locking body 4 only if the forces exerted onto the cap 2 exceed a minimum threshold value that is defined mainly by the characteristics of the frangible portion(s) 30 and materials used, Here, the peripheral rim 23 and that part of the cap 2 positioned outside the annular web 43 in radial direction serve as an actuating lever that is pivotally supported on the upper surface of the annular web, which may be curved according to the profile of the bottom surface 26 of the cap 2, as outlined above. This actuating lever results in a corresponding pivoting of the much shorter lever formed by the cylindrical protrusion 28, which then starts to tear the indicator ring 32 upwards. Because the indicator ring 32 is clamped or accommodated with axial play in the notch-shaped annular region formed between the upper surface of plug 35 and the bottom surface 47*b* of the annular web 47, the resulting forces will finally result in breakage of the frangible portion(s) 30 along the entire perimeter of the central opening 46. Finally, the cap 2 can be removed from the locking body 4, which will result in the state shown in FIGS. 3*c* and 4, providing access to the plug 85 from outside the locking body 4.

Of course, the cap may also be coupled to the locking body in a step subsequent to manufacturing these two components. As shown in FIG. 2*a*, for this purpose the cap 2 may be pushed onto the locking 4, to thereby snap-fit the indicator ring 32 into the central opening 46 of the locking body 4 and established a positive-fit engagement. This assembly is eased by providing the radial protrusion 47 with an upper surface 47*a* that is slanted towards the distal end 42 under an acute angle and the bottom surface of indicator ring 32 with a convexly curved profile, as shown in FIG. 2*a*. When the cap 2 is pushed onto the locking body 4, the bottom surface of indicator ring 32 will first come in contact with the slanted upper surface 47*a* of the radial protrusion 47. The indicator ring 32 will then flex toward the bottom of the cap 2 and slide over the slanted upper surface 47*a* of the radial protrusion 47. Finally, the radial ring 32 will flex back outwards in radial direction and grip-behind the radial protrusion 47, which will result in the mechanical coupling of the cap 2 with the locking member 4, as shown in FIG. 2*a*.

With reference to FIGS. 6*a* to 6*c*, a second embodiment of a tamper evident plastic closure according to the present invention will be described. In FIG. 6*a* the two components of the closure, namely the cap 2 and the locking body 4, are shown in a state before coupling the cap 2 with the tubular locking body 4. Different to the first embodiment, the front end 28*a* of the cylindrical protrusion 28, which is formed in front of the frangible portion 30, has an outer diameter that fits into the central opening of the annular web 43. Hence, the cylindrical protrusion 28 with its front end 28*a* can be inserted into the central opening of the annular web 43 unhindered, as shown in FIG. 6*b*, for mounting the cap 2 to the locking body 4. In the state of FIG. 6*b*, the front end 28*a* of the cylindrical protrusion 28 is irreversibly deformed in the manner of a rivet to establish the positive-fit engagement of the coupling portion 28 with the central opening provided in the annular web 43 of the locking body 4. To this end, a cylindrical counter-member may be inserted from the bottom end 42 of the locking body 4 into the interior of the locking body 4 until it abuts against the front end 28*a* of the cylindrical protrusion 28 in the state shown in FIG. 6*b*. Exerting a suitable pressure between the counter-member and the cap 2 while pressing the cap 2 against the locking body 4 may be sufficient to cause an irreversible plastic deformation of the front end 28*a* to finally obtain the final state shown in FIG. 6*c*, where the deformed front end of the cylindrical protrusion forms an indicator ring 32, which grips behind the bottom surface 47*b* of the radial protrusion 47 of the annular web 43 in the manner of a rivet to thereby establish the positive-fit engagement of the coupling portion 28 with the central opening provided in the annular web 43 of the locking body 4.

As will become apparent to the skilled person, this irreversible deformation of the front end 28*a* of the cylindrical protrusion 28 may be further assisted by heating and simultaneously deforming the front end 28*a*. To this end, the afore-mentioned cylindrical counter-member may be provided with a heater capable of heating the front ends 28*a* of the cylindrical protrusions 28 to a softened state easing the deformation of the front end 28*a* to finally obtain the mushroom-shaped riveting structure shown in FIG. 6*c* that couples the cap 2 with the locking body 4.

FIG. 6*d* shows detail A of FIG. 6*a* on a larger scale. This feature may apply to all embodiments of the tamper evident plastic closure for vials according to the present invention. As with the previous embodiments, the bottom skirt 48 of the locking body may be provided with a larger wall thickness than the side-wall 40 so that the resilient locking tabs 52 are supported on a circumferential radial step 49 protruding inwards in radial direction, which divides the inner volume of the locking body into an upper receptacle and a bottom receptacle 50. In order to provide more resiliency to the locking tabs 52, an axial groove 52*a* is each provided between the side-wall 40 and the bases or roots 52*b* of the locking tabs 52. Thus, the resiliency to the locking tabs 52 can be adjusted according to requirements, by adjusting the radial width and/or axial depth of the axial groove 52*a*, and thus by adjusting the width of the bases or roots 52*b* of the locking tabs 52.

As shown in FIG. 6*e*, the axial groove 52*a* may correspond to a bottom portion of an axial recess 40*b* formed on the inner surface 40*a* of side-wall 40. The depth of this axial recess 40*b* may be constant along in axial direction, if one disregards a minor inclination angle that is usually caused by manufacturing by injection-molding, which requires small deforming angles for releasing the finished product from a mold used for injection-molding. The width of each axial recess 40*b* in circumferential direction may correspond to the width of the associated recess 45 on the upper surface of the tubular locking body 4. Thus, sliders of a mold for injection-molding may be inserted from above until the bottom portion of groove 52*a*, for forming the axial recesses 40*b* together with the associated recesses 45 on the upper surface of the tubular locking body 4. Preferably, the front end 52*c* of each locking tab 52 does not project in radial direction beyond the outer rim of annular web 43, if viewed from above. Thus, also the locking tabs 52 can be formed easily by injection-molding using the same mold. As shown in FIG. 6*e*, the front end 52*c* of each locking tab 52 may be formed a as a generally flat surface extending in horizontal direction or just under a slight acute angle relative to a horizontal reference plane, to enable firm grip under the expanded upper rim 82 (see FIG. 3*b*) of a vial.

As shown in FIG. 6*e*, circumferential radial ridges 40*c* may be formed on those portions of the inner surface 40*a* of side-wall 40 formed below the radial webs 44, for further stiffening the tubular locking body 4. These ridges 40*c* are only interrupted by the afore-mentioned axial recesses 40*b*.

The height of the bottom receptacle 50 generally corresponds to the axial length of the neck portion 81 of a vial 8 (see FIG. 3*b*) so that the region where the resilient locking tabs 52 engage with the bottom side of the upper rim 82 of a vial 8 is reliably protected. On the other hand, the height of the upper receptacle 51 that is formed between the upper ends of the locking tabs 52 and the bottom surface of the annular web 43 generally corresponds to or may be slightly less than the height of the upper rim 82 of a vial and the thickness of the peripheral rim of a plug 85 (see FIG. 3*b*) so that the peripheral rim of the plug 85, if required, may be firmly pressed onto the upper rim 82 of a vial to seal the mouth 83 in a gas-tight manner. At the same time that portion on the upper surface of the plug 85 inside the central opening 46 may be sealed in a sterile manner as outlined below in more detail, for preventing intrusion of contaminants into this region, although such a sterile sealing of the plug 85 is not of primary importance according to the present invention and may also not be provided. In other words, when the locking body 4 is locked at the neck of a vial, there may exist a certain axial play between the bottom surface of the annular web 43 and the upper surface of a plug disposed in the mouth of the vial and between the indicator ring 32 and the upper surface of the plug, so that the upper surface of the plug is not kept under sterile conditions inside the tamper evident plastic closure 1.

With reference to FIGS. 7*a* and 7*b* an additional feature will be described that may apply to all embodiments of a tamper evident plastic closure according to the present invention. As shown in FIGS. 7*a* and 7*b*, at least one window 59 is formed in the side-wall 40 of the tubular locking body 4 that may serve as a venting hole to enable a fluid-path between the inner volume of the closure 1 and ambient. More specifically, the at least one window 59 is provided at the level of the upper receptacle 51 (see FIG. 2*a*) of the locking body. Preferably, at least one pair of such venting holes 59 is provided at diametric opposite positions of the side-wall 40 at the same level. The at least one venting hole 59 serves to establish a fluid-path between the ambient and the upper surface of the plug and/or an outer surface of the vial in the region of the neck and flange of the vial when the tamper evident plastic closure 1 is locked at the neck of the vial. Such venting holes 59 may ease the removal of moisture and residual materials during production of the closure 1 or later further processing, such as sterilization or use during lyophilizing the content of the vial. For this purpose, it is important that the respective region of the vial or plug, from where the moisture and residual materials is to be removed, will be in fluid communication with the at least one venting hole 59, which can be ensured by a proper design of the closure 1 and mounting to a vial.

With reference to FIG. 3*c* an additional feature will be described that may apply to all embodiments of a tamper evident plastic closure according to the present invention. As outlined above, a tamper evident plastic closure according to the present invention does not necessarily seal that region of the plug 85 that is pierced at a later stage by the needle or distal tip of a syringe under sterile conditions. Therefore, in a tamper evident plastic closure according to the present invention the central opening 46 of the locking body 4 is preferably configured such that an upper surface of the plug 85 of the vial 8 can be disinfected easily by a swab after removal of the cap from the locking body 4 by irreversibly breaking the annular frangible portion. For this purpose, the depth and diameter of the central opening 46 of the locking body 4 are of such dimensions that a user can easily disinfect the upper surface of the plug 85 by means of a swab that is soaked by a disinfecting agent, such a alcohol, before actually piercing the plug 85 by the needle or distal tip of a syringe. In other words, the depth and diameter of the central opening 46 of the locking body 4 are of such dimensions that a swab can be easily inserted into the central opening 46 by means of e.g. the user's forefinger and that basically the entire area of the central opening 46 on the upper surface of plug 85 can be cleaned and disinfected by the swab.

To further ease insertion of a swab into the central opening and disinfection of basically the entire area of the central opening 46 on the upper surface of plug 85, the rim of the central opening 46 is formed by a slanted surface 47*a* extending at an acute angle relative to a line perpendicular to the axial direction of the tubular locking body 4 so that a virtual extension line (not shown) of the slanted surface 47*a* intersects the upper surface of the plug 85 at or near the radial position of the rim of the indicator ring 32, which corresponds to the inner surface of the cylindrical coupling protrusion 28 before breaking the annular frangible portion 30, as can be concluded from FIG. 3*b*.

A tamper evident plastic closure according to the present invention can thus be used to reliably cover or seal the plug of a vial during storage and transportation, and provides easy access to the content of the vial after removal of the cap by irreversibly breaking the at least one frangible portion of the coupling protrusion. After breaking the at least one frangible portion of the coupling protrusion, at least one indicator member, which is preferably formed as an indicator ring, remains in the central opening of the locking tab as a clearly visible tamper evidence indicator, which also reliably prevents closing or re-sealing the plug by means of a replacement cap.

The present invention also relates to the following embodiments that can be combined with the subject-matter of any of appended claims 2 to 16 or 17 to 18:

Embodiment A

A method for withdrawal of a liquid including a substance for medical or pharmaceutical applications from a vial (8), which is sealed by a plug (85) that is covered by a tamper evident plastic closure (1) as claimed in any of claims 1 to 12, comprising:

- pushing a peripheral rim (23) of the disc-shaped cover (20) away from the tubular locking body (4) for removing the cap (2) from the distal end of the tubular locking body (4) such that the at least one frangible portion (30) is broken and the at least one indicator member (33) is left behind at the rim (47) of the central opening (46) of the tubular locking body (4) to thereby provide access to the inside of the vial (8) via the plug (85);
- piercing a central portion of the plug (85) with the front tip of a syringe penetrating the central opening (46) of the tubular locking body (4); and
- withdrawal of the liquid from the vial (8) by pulling a piston of the syringe.

Embodiment B

The method for withdrawal of a liquid of Embodiment A, wherein first a liquid is injected into the inside of the vial (8) via the plug (85) by pushing the piston of the syringe and a substance stored inside the vial (8) is mixed with the liquid injected into the vial (8) before the liquid including the substance for medical or pharmaceutical applications is withdrawn from the vial (8).

Embodiment C

A tamper evident plastic closure for vials (8) for storing substances for medical or pharmaceutical applications having a neck (81) with a flange (82) at an axial end thereof, for holding a plug (85) in a mouth (83) of a vial, said plastic closure (1) comprising:

- a tubular locking body (4) having a distal end (41) and a proximal end (42) and being configured to be locked at the neck (81) of the vial (8), and
- a cap (2) coupled with the tubular locking body (4) at the distal end; wherein
- the tubular locking body (4) comprises:
  - a retaining member (43) provided at the distal end (41), configured for retaining the plug (85) to be held in the mouth (83) of the vial (4), wherein a central opening (46) is formed in the retaining member (43) for providing access from the outside of the tubular locking body (4) to the inside of the vial (8) via the plug (85); and wherein the cap (2) comprises:
  - a disc-shaped cover (20) for covering the distal end (41) of the tubular locking body (4) and covering the central opening (46) of the tubular locking body (4);
- wherein the disc-shaped cover (20) is coupled to the retaining member (43) by positive-fit engagement of a coupling portion (28, 30, 21) protruding from a bottom surface (26) of the disc-shaped cover (20) with the central opening (46) of the tubular locking body (4); wherein
- the coupling portion comprises an annular frangible portion (30) so that the cap (2) can be removed from the tubular locking body (4) by irreversibly breaking the annular frangible portion (30) for providing access to the inside of the vial (8) via the plug (85); wherein
- the central opening (46) is configured such that an upper surface of the plug (85) can be disinfected by a swab after removal of the cap (2) from the tubular locking body (4) by irreversibly breaking the annular frangible portion (30).

Embodiment D

The tamper evident plastic closure of Embodiment C, wherein

- a rim of the central opening (46) is formed by a slanted surface (47*a*) extending at an acute angle relative to a line perpendicular to the axial direction of the tubular locking body (4) so that a virtual extension line of the slanted surface (47*a*) intersects the upper surface of the plug (85) at a radial position or near the radial position of an inner surface of the coupling portion (28, 30, 32) before breaking the annular frangible portion (30), and/or
- an opening width and/or depth of the central opening (46) is dimensioned such that a swab can be inserted into the central opening (46) by the finger of a user for disinfection of the upper surface of the plug (85).

Embodiment E

A tamper evident plastic closure for vials (8) for storing substances for medical or pharmaceutical applications having a neck (81) with a flange (82) at an axial end thereof, for holding a plug (85) in a mouth (83) of a vial, said plastic closure (1) comprising:

a tubular locking body (4) having a distal end (41) and a proximal end (42) and being configured to be locked at the neck (81) of the vial (8), and a cap (2) coupled with the tubular locking body (4) at the distal end; wherein the tubular locking body (4) comprises:

a retaining member (43) provided at the distal end (41), configured for retaining the plug (85) to be held in the mouth (83) of the vial (4), wherein a central opening (46) is formed in the retaining member for providing access from the outside of the tubular locking body (4) to the inside of the vial (8) via the plug (85); and wherein the cap (2) comprises:

a disc-shaped cover (20) for covering the distal end (41) of the tubular locking body (4) and covering the central opening (46) of the tubular locking body (4);

wherein the disc-shaped cover (20) is coupled to the retaining member (43) by positive-fit engagement of a coupling portion (28, 30, 32) protruding from a bottom surface (26) of the disc-shaped cover (20) with the central opening (46) of the tubular locking body (4); wherein the coupling portion (28) comprises an annular frangible portion (30) so that the cap (2) can be removed from the tubular locking body (4) by irreversibly breaking the annular frangible portion (30) for providing access to the inside of the vial (8) via the plug (85); wherein at least one window (59) is formed in a side-wall (40) of the tubular locking body (4) and a fluid-path is formed between an ambient and the upper surface of the plug (85) and/or an outer surface of the vial in the region of the neck (81) and flange (82) when the tamper evident plastic closure (1) is held in the mouth (83) of the vial (8).

LIST OF REFERENCE NUMERALS

1 closure
2 cap
4 locking body
8 vial
20 central body
21 cylindrical recess
22 outer cover portion
23 peripheral rim
24 recess
25 upper rim
26 bottom surface
28 cylindrical protrusion
28*a* deformation portion of cylindrical protrusion
29 slanted surface of cylindrical protrusion 28
30 annular frangible portion
32 indicator ring
33 visible portion of indicator ring 32
34 peripheral rim
35 slanted surface of peripheral rim 34
40 side-wall
40*a* inner surface of side-wall 40
40*b* axial recess on inner surface 40*a*
40*c* radial ridge on inner surface 40*a*
41 upper (distal) end
42 bottom (proximal) end
43 annular web
44 radial web
45 recess
46 central opening
47 radial protrusion of annular web 43
47*a* slanted upper surface of radial protrusion 47
47*b* slanted bottom surface of radial protrusion 47
47*c* front end of protrusion 47
48 bottom skirt
49 step
50 bottom receptacle
51 upper receptacle
52 locking tab
52*a* groove
52*b* basis of locking tab 52
53 positioning member
59 venting window
80 side-wall
81 neck
82 expanded upper rim
83 mouth
84 bottom
85 plug or stopper
96 central body
A detail in FIG. 6*a*

The invention claimed is:

1. A tamper evident plastic closure for vials (8) for storing substances for medical or pharmaceutical applications having a neck (81) with a flange (82) at an axial end thereof, for holding a plug (85) in a mouth (83) of a vial, said plastic closure (1) comprising:

a tubular locking body (4) having a distal end (41) and a proximal end (42) and being configured to be mounted at the neck (81) of the vial (8), and a cap (2) coupled with the tubular locking body (4) at the distal end; wherein the tubular locking body (4) comprises:

a retaining member (43) provided at the distal end (41), configured for retaining the plug (85) to be held in the mouth (83) of the vial (4), wherein a central opening (46) is formed in the retaining member (43) for providing access from the outside of the tubular locking body (4) to the inside of the vial (8) via the plug (85); and wherein the cap (2) comprises:

a disc-shaped cover (20) for covering the distal end (41) of the tubular locking body (4) and covering the central opening (46) of the tubular locking body (4), and a coupling portion (28, 30, 32) provided at a center of the disc-shaped cover (20) and protruding from a bottom surface (26) thereof, for coupling the cap (2) with the tubular locking body (4) by positive-fit engagement of the coupling portion (28, 30, 32) with the central opening (46); wherein the cap (2) and the tubular locking body (4) are formed as separate members, and the tubular locking body (4) is formed as a single-piece sleeve configured to cover the entire region of the neck (81) of the vial (8); wherein the coupling portion comprises:

an annular frangible portion (30) integrally formed with the disc-shaped cover (20) and protruding from the bottom surface (26) of the disc-shaped cover (20), a cylindrical protrusion (28) protruding from the bottom surface (26) of the disc-shaped cover (20) and an indicator ring (33); wherein the cylindrical protrusion (28) and the indicator ring (33) are connected with each other via the annular frangible portion (30) so that, after removal of the disc-shaped cover (20) from the distal end of the tubular locking body (4) by irreversibly breaking the annular frangible portion (30) for providing access to the inside of the vial (8) via the plug (85), the indicator ring (33) remains as a tamper evidence at the rim (34) of the central opening (46) that is clamped or held with axial play between the bottom of the retaining member (43) and an upper surface of the plug (85) and protrudes in radial direction inward beyond the rim (34) of the central opening (46) into the central opening (46).

2. The tamper evident plastic closure as claimed in claim 1, wherein a plurality of locking tabs (52) or protrusions are integrally formed on an inner surface of the tubular locking body (4), wherein the locking tabs (52) or protrusions are configured to lock the tubular locking body (4) at the neck (81) of the vial.

3. The tamper evident plastic closure as claimed in claim 2, wherein the retaining member is formed as an annular web (43), which is connected with a cylindrical side-wall (40) of the tubular locking body (4) via a plurality of radial webs (44) spaced apart from each other along the perimeter of the tubular locking body (4), a plurality of recesses (45) being formed between adjacent radial webs (44), and wherein the plurality of locking tabs (52) is provided near the proximal end (42) of the tubular locking body (4) at positions corresponding to the plurality of recesses (45).

4. The tamper evident plastic closure as claimed in claim 3, wherein the radial protrusion (47) comprises a slanted upper and bottom surface (47*a*, 47*b*) formed along the perimeter of the central opening (46), each extending at an acute angle relative to a plane perpendicular to an axial direction of the tubular locking body (4), and wherein the slanted surfaces (47*a*, 47*b*) enclose at least one linear rim portion (47*c*) extending in the axial direction of the tubular locking body (4).

5. The tamper evident plastic closure as claimed in claim 4, wherein an upper surface (35) of the indicator ring (33) is included toward the bottom surface (26) of the cap under an acute angle which is the same as the acute angle formed between the slanted bottom surface (47*b*) of the radial protrusion (47) and the plane perpendicular to the axial direction of the tubular locking body.

6. The tamper evident plastic closure as claimed in claim 2, wherein a radial protrusion (47) of a thickness less than a thickness of the annular web (43) protrudes from the annular web (43) inward in radial direction into the central opening (46).

7. The tamper evident plastic closure as claimed in claim 4, wherein an upper surface (35) of the indicator ring (33) extends in parallel with the slanted bottom surface (47*b*) of the radial protrusion (47).

8. The tamper evident plastic closure as claimed in claim 6, wherein a bottom surface of the indicator ring (33) is convexly curved.

9. The tamper evident plastic closure as claimed in claim 1, wherein a peripheral rim (23) of the cap (2) protrudes in radial direction outward beyond an outer surface of the tubular locking member (4) and a ring-shaped concave recess is formed on an upper surface of the disc-shaped cover (20).

10. The tamper evident plastic closure as claimed in claim 1, wherein the coupling portion (28, 30, 32) is snap-fitted into the central opening (46), for establishing the positive-fit engagement of the coupling portion (28) with the central opening (46).

11. The tamper evident plastic closure as claimed in claim 1, wherein a front end (28*a*) of the coupling portion (28, 30, 32) is irreversibly deformed by plastic deformation or by heating and plastic deformation for establishing the positive-fit engagement of the coupling portion (28, 30, 32) with the central opening (46).

12. The tamper evident plastic closure as claimed in claim 1, wherein a skirt (48) at the proximal end (42) of the tubular locking body (4) has a larger wall thickness than a cylindrical side-wall (40) at the distal end (41) of the tubular locking body (4), a circumferential radial step (49) is provided on an inner surface of the skirt (48), and the plurality of locking tabs (52) is supported on the circumferential radial step (48), wherein an axial groove (52*a*) is each formed between an inner surface of the cylindrical side-wall (40) and bases or roots (52*b*) of the locking tabs (52), for adjusting the resiliency of the plurality of locking tabs (52) by adjustment of the radial widths and/or axial depths of the axial grooves (52*a*).

13. The tamper evident plastic closure as claimed in claim 1, wherein the central opening (46) is configured such that an upper surface of the plug (85) can be disinfected by a swab after removal of the disc-shaped cover (20) from the tubular locking body (4) by irreversibly breaking the annular frangible portion (30).

14. The tamper evident plastic closure as claimed in claim 13, wherein a rim of the central opening (46) is formed by a slanted surface (47*a*) extending at an acute angle relative to a line perpendicular to the axial direction of the tubular locking body (4) so that a virtual extension line of the slanted surface (47*a*) intersects the upper surface of the plug (85) at a radial position or near the radial position of an inner surface of the coupling portion (28, 30, 32) before breaking the annular frangible portion (30).

15. The tamper evident plastic closure as claimed in claim 13, wherein an opening width and/or depth of the central opening (46) is dimensioned to accommodate a swab configured to be inserted into the central opening (46) by a finger of a user for disinfection of the upper surface of the plug.

16. The tamper evident plastic closure as claimed in claim 1, wherein at least one window (59) is formed in a side-wall (40) of the tubular locking body (4), for enabling formation of and a fluid-path is formed between an ambient and the upper surface of the plug (85) and/or an outer surface of the vial in the region of the neck (81) and flange (82) when the tamper evident plastic closure (1) is held in the mouth (83) of the vial (8).

17. A tamper evident plastic closure for necked vials (8) storing substances for medical or pharmaceutical applications, for holding a plug (85) in a mouth (83) of a vial, said plastic closure (1) comprising:

a tubular locking body (4) configured to be mounted at the neck (81) of the vial (8), and a cap (2) coupled with the tubular locking body (4) at a distal end thereof; wherein the tubular locking body (4) comprises:

a retaining member (43) for retaining the plug (85) to be held in the mouth (83) of the vial (4), a central opening (46) being formed in a distal end (41) of the retaining member (43); and wherein the cap (2) comprises:

a disc-shaped cover (20) for covering the distal end (41) of the retaining member (43), and a central coupling portion (28, 30, 32) protruding from a bottom surface (26) of the disc-shaped cover (20), for coupling the cap (2) with the tubular locking body (4) by positive-fit engagement of the coupling portion (28, 30, 32) with the central opening (46) of the retaining member (43); wherein the central coupling portion comprises:

a cylindrical protrusion (28) protruding from the bottom surface (26) of the disc-shaped cover (20) and comprising a frangible portion (30) configured to be irreversibly broken for removing the disc-shaped cover (20) from the distal end (41) of the tubular locking body (4), and an indicator ring (33) on a side of the frangible portion (30) opposite to the disc-shaped cover (20); wherein a width of the central opening (46) corresponds to an outer diameter of the cylindrical protrusion (28) at the frangible portion (30), and a width of the indicator ring (33) is larger than the width of the central opening (46), so that the indicator ring (33) remains as a tamper evidence at the rim (34) of the central opening (46) of the tubular locking body (4) after removal of the cap (2) from the distal end of the tubular locking body (4).

18. The tamper evident plastic closure as claimed in claim 17, wherein, after removal of the disc-shaped cover (20) from the distal end of the tubular locking body (4), the indicator ring (33) remains clamped or held with axial play between the bottom of the retaining member (43) and an upper surface of the plug (85) to protrude in radial direction inward beyond the rim (34) of the central opening (46) of the tubular locking body (4) into the central opening (46).

19. In a method for withdrawal of a liquid including a substance for medical or pharmaceutical applications from a vial (8), which is sealed by a plug (85) and closed by a tamper evident plastic closure (1) retaining the plug (85) to be held in a mouth (83) of the vial (4), the tamper evident plastic closure (1) comprising a tubular locking body (4) mounted at the neck (81) of the vial (8) and a cap (2) having a disc-shaped cover (20) coupled with the tubular locking body (4) by positive-fit engagement of a central coupling portion (28, 30, 32) with a central opening (46) of the tubular locking body (4), said tubular locking body (4) comprising a retaining member (43) provided at a distal end (41) thereof retaining the plug (85) in the mouth (83) of the vial (4), and said central coupling portion (28, 30, 32) being integrally formed with an indicator ring (33) at a bottom end thereof and comprising an annular frangible portion (30), performing the steps of pushing the disc-shaped cover (20) away from the tubular locking body (4) to thereby break the annular frangible portion (30) and remove the disc-shaped cover (20) from a distal end of the tubular locking body (4) for providing access to the plug (85) via the opening (46), piercing a central portion of the plug (85) with the front tip of a syringe penetrating the central opening (46) of the tubular locking body (4), withdrawal of the liquid from the vial (8) via the front tip of the syringe by pulling a piston of the syringe, and leaving behind the indicator ring (33) as a tamper evidence at the rim (34) of the central opening (46) clamped or held with axial play between the bottom of the retaining member (43) and an upper surface of the plug (85) and protruding in radial direction inward beyond the rim (34) of the central opening (46) of the tubular locking body (4) into the central opening (46) so as to be visible in the central opening (46) of the tubular locking body (4) and prevent closing or re-sealing the plug by means of a replacement cap.

20. A method for sealing a vial (8) for storing a substance for medical or pharmaceutical applications having a neck (81) with a flange (82) at an axial end thereof, comprising:

providing the vial (8) and filling the vial with the substance;

providing a tamper evident plastic closure (1);

closing the vial by inserting a plug (85) into a mouth (83) of the vial;

putting the tamper evident plastic closure (1) onto the axial end of the vial; and locking the tubular locking body (4) at the neck (81) of the vial (8), so that a retaining member (43) retains the plug (85) on the flange (82) of the vial and an indicator ring (33) abuts against a bottom of the retaining member (43); wherein the tamper evident plastic closure (1) comprises:

the tubular locking body (4) having a distal end (41) and a proximal end (42) and being configured to be mounted at the neck (81) of the vial (8), and a cap (2) coupled with the tubular locking body (4) at the distal end; wherein the tubular locking body (4) comprises:

the retaining member (43) provided at the distal end (41), configured for retaining the plug (85) to be held in the mouth (83) of the vial (4), wherein a central opening (46) is formed in the retaining member (43) for providing access from the outside of the tubular locking body (4) to the inside of the vial (8) via the plug (85); and wherein the cap (2) comprises:

a disc-shaped cover (20) for covering the distal end (41) of the tubular locking body (4) and covering the central opening (46) of the retaining member (43), and a coupling portion (28, 30, 32) provided at a center of the disc-shaped cover (20) and protruding from a bottom surface (26) thereof, for coupling the cap (2) with the tubular locking body (4) by positive-fit engagement of the coupling portion (28, 30, 32) with the central opening (46) of the retaining member (43); wherein the cap (2) and the tubular locking body (4) are formed as separate members, and the tubular locking body (4) is formed as a single-piece sleeve configured to cover the entire region of the neck (81) of the vial (8); wherein the coupling portion comprises:

an annular frangible portion (30) integrally formed with the disc-shaped cover (20) and protruding from the bottom surface (26) of the disc-shaped cover (20), a cylindrical protrusion (28) protruding from the bottom surface (26) of the disc-shaped cover (20) and the indicator ring (33); wherein the cylindrical protrusion (28) and the indicator ring (33) are connected with each other via the annular frangible portion (30) so that, after removal of the disc-shaped cover (20) from the distal end of the tubular locking body (4) by irreversibly breaking the annular frangible portion (30) for providing access to the inside of the vial (8) via the plug (85), the indicator ring (33) remains as a tamper evidence at the rim (34) of the central opening (46) of the retaining member (43) that is clamped or held with axial play between the bottom of the retaining member (43) and an upper surface of the plug (85) and protrudes in radial direction inward beyond the rim (34) of the central opening (46) of the retaining member (43) into the central opening (46).

21. The method as claimed in claim 20, wherein the step of putting the tamper evident plastic closure (1) onto the axial end of the vial or the step of providing the tamper evident plastic closure (1) comprises:

snap-fitting the coupling portion (28, 30, 32) into the central opening (46) of the tubular locking body (4) or irreversibly deforming a front end (28*a*) of the coupling portion (28, 30, 32) by plastic deformation or by heating and plastic deformation, for establishing the positive-fit engagement of the coupling portion (28, 30, 32) with the central opening (46) of the tubular locking body (4).

22. The method as claimed in claim 20, wherein after the step of providing the tamper evident plastic closure (1) the plug (85) is retained inside the tubular locking body (4) by a plurality of locking tabs (52) or protrusions provided on an inner surface of the tubular locking body (4), and the vial is closed by putting the tamper evident plastic closure (1) onto the axial end of the vial and locking the tubular locking body (4) at the neck (81) of the vial (8), for inserting the plug (85) into the mouth (83) of the vial.

* * * * *